US012692852B2

(12) United States Patent
Jeon et al.

(10) Patent No.: US 12,692,852 B2
(45) Date of Patent: Jul. 28, 2026

(54) RECIPROCATING COMPRESSOR WITH DUAL OIL PUMP

(71) Applicant: Samsung Electronics Co., Ltd., Suwon-si (KR)

(72) Inventors: Wooju Jeon, Suwon-si (KR); Ohyeok Kwon, Suwon-si (KR); Kyungmin Kim, Suwon-si (KR); Yongtae Kim, Suwon-si (KR); Jiwoong Kim, Suwon-si (KR); Kisun Nam, Suwon-si (KR); Kichul Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 10 days.

(21) Appl. No.: 18/882,040

(22) Filed: Sep. 11, 2024

(65) Prior Publication Data

US 2025/0075692 A1 Mar. 6, 2025

Related U.S. Application Data

(63) Continuation of application No. PCT/KR2024/012374, filed on Aug. 20, 2024.

(30) Foreign Application Priority Data

Aug. 30, 2023 (KR) ..... 10-2023-0114823
Jan. 12, 2024 (KR) ..... 10-2024-0005348

(51) Int. Cl.
*F04B 39/02* (2006.01)
*F04B 35/04* (2006.01)

(52) U.S. Cl.
CPC ..... *F04B 39/0261* (2013.01); *F04B 39/0246* (2013.01); *F04B 39/0253* (2013.01); *F04B 39/0276* (2013.01); *F04B 35/04* (2013.01)

(58) Field of Classification Search
CPC ..... F04B 39/0238; F04B 39/0246; F04B 39/0253; F04B 39/0261; F04B 39/0276
See application file for complete search history.

(56) References Cited

U.S. PATENT DOCUMENTS 6,773,225 B2 8/2004 Yuri et al.
2006/0013706 A1 1/2006 Ishida et al.
(Continued)

FOREIGN PATENT DOCUMENTS

CN 106401915 B 11/2018
CN 109322813 A 2/2019
(Continued)

OTHER PUBLICATIONS

Machine translation of KR 1020230084815 A, accessed Nov. 12, 2025. (Year: 2025).*
(Continued)

*Primary Examiner* — Jonathan R Matthias
(74) *Attorney, Agent, or Firm* — Jefferson IP Law, LLP

(57) ABSTRACT

A reciprocating compressor is provided. The reciprocating compressor includes a case containing an oil reservoir, a motor including a stator disposed inside the case and a rotor that rotates with respect to the stator, a drive shaft that rotates integrally with the rotor and including a cavity formed at a lower portion thereof, a primary oil pump inserted into the cavity of the drive shaft and disposed in the case, a secondary oil pump into which a lower end portion of the drive shaft is inserted and coupled to the primary oil pump, a primary oil passage formed between an inner circumferential surface of the cavity of the drive shaft and the primary oil pump, and a secondary oil passage formed around the primary oil pump between an outer circumferential surface of the lower end portion of the drive shaft and the secondary oil pump, wherein, when the drive shaft rotates, oil contained in the oil reservoir moves to an upper portion of the cavity of the drive shaft along the primary oil passage and the secondary oil passage.

18 Claims, 37 Drawing Sheets

(56) References Cited

U.S. PATENT DOCUMENTS

| | | | | |
|---|---|---|---|---|
| 2007/0081908 | A1 | 4/2007 | Nishihara | |
| 2021/0115922 | A1 | 4/2021 | Huang et al. | |
| 2021/0310471 | A1 * | 10/2021 | Tramposch | F04B 39/0246 |
| 2022/0170475 | A1 | 6/2022 | Park et al. | |

FOREIGN PATENT DOCUMENTS

| | | | | | |
|---|---|---|---|---|---|
| CN | 111412140 | A | | 7/2020 | |
| CN | 115929592 | A | | 4/2023 | |
| CN | 114992091 | B | * | 11/2023 | F04B 39/0094 |
| JP | 2004-003494 | A | | 1/2004 | |
| JP | 2005-337158 | A | | 12/2005 | |
| JP | 6138625 | B2 | | 5/2017 | |
| KR | 10-2005-0083696 | A | | 8/2005 | |
| KR | 10-2006-0120119 | A | | 11/2006 | |
| KR | 10-2022-0075122 | A | | 6/2022 | |
| KR | 10-2023-0084815 | A | | 6/2023 | |
| KR | 20230084815 | A | * | 6/2023 | F04B 39/023 |
| WO | WO-2015049192 | A1 | * | 4/2015 | F04B 39/0253 |

OTHER PUBLICATIONS

International Search Report with English translation and Written Opinion dated Dec. 16, 2024; International Appln. No. PCT/KR2024/012374.

* cited by examiner

RECIPROCATING COMPRESSOR WITH DUAL OIL PUMP

CROSS-REFERENCE TO RELATED APPLICATION(S)

This application is a continuation application, claiming priority under § 365(c), of an International application No. PCT/KR2024/012374, filed on Aug. 20, 2024, which is based on and claims the benefit of a Korean patent application number 10-2023-0114823, filed on Aug. 30, 2023, in the Korean Intellectual Property Office, and of a Korean patent application number 10-2024-0005348, filed on Jan. 12, 2024, in the Korean Intellectual Property Office, the disclosure of each of which is incorporated by reference herein in its entirety.

BACKGROUND

1. Field

The disclosure relates to a reciprocating compressor. More particularly, the disclosure relates to a reciprocating compressor with a dual oil pump.

2. Description of the Related Art

A compressor is a mechanical device that compresses incoming gas, increases its pressure, and discharges the compressed gas. The compressor may be classified into a reciprocating type compressor and a rotating type compressor according to its operating principle.

The rotating type compressor may include a rotary compressor and a scroll compressor.

The reciprocating type compressor may include a reciprocating compressor that converts the rotational motion of a motor into the linear reciprocating motion of a piston using a crank shaft and a connecting rod to suck, compress, and discharge gas.

Generally, the reciprocating compressor uses an oil pump operated by the rotation of the motor to supply oil to internal components.

However, when the reciprocating compressor operates at a low speed, the amount of oil supplied to the internal components by the oil pump may be reduced.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a reciprocating compressor with a dual oil pump.

Additional aspects will be set forth in part in the description which follows and, in part, will be apparent from the description, or may be learned by practice of the presented embodiments.

In accordance with an aspect of the disclosure, a reciprocating compressor is provided. The reciprocating compressor includes a case containing an oil reservoir, a motor including a stator disposed inside the case and a rotor that rotates with respect to the stator, a drive shaft that rotates integrally with the rotor and includes a cavity formed at a lower portion thereof, a primary oil pump inserted into the cavity of the drive shaft and disposed in the case, a secondary oil pump into which a lower end portion of the drive shaft is inserted and coupled to the primary oil pump, a primary oil passage formed between an inner circumferential surface of the cavity of the drive shaft and the primary oil pump, and a secondary oil passage formed around the primary oil pump between an outer circumferential surface of the lower end portion of the drive shaft and the secondary oil pump, wherein, when the drive shaft rotates, oil contained in the oil reservoir moves to an upper portion of the cavity of the drive shaft along the primary oil passage and the secondary oil passage.

According to an embodiment of the disclosure, the drive shaft includes a helical shaped first oil supply passage formed on an outer circumferential surface of an upper portion of the drive shaft. The secondary oil pump is formed in a shape of a cylindrical container with a bottom.

According to an embodiment of the disclosure, the drive shaft includes a communication hole formed adjacent to an upper end of the cavity. The oil contained in the oil reservoir flows into the secondary oil pump through a lower portion of the secondary oil pump. Some of the oil flowing into the secondary oil pump moves upward along the primary oil passage. Remaining oil moves upward along the secondary oil passage, flows into the cavity through the communication hole, and moves to the upper portion of the cavity along with the some of the oil moving along the primary oil pump.

According to an embodiment of the disclosure, the secondary oil passage is formed as a helical groove formed on the outer circumferential surface of the lower portion of the drive shaft inserted into the secondary oil pump. A helical direction of the helical groove of the secondary oil passage is identical to a helical direction of the first oil supply passage.

According to an embodiment of the disclosure, the secondary oil passage is formed as a helical groove formed on the inner circumferential surface of the secondary oil pump. A helical direction of the helical groove of the secondary oil passage is opposite to a helical direction of the first oil supply passage.

According to an embodiment of the disclosure, the secondary oil pump includes a plurality of oil inlets formed in at least one of a bottom and a lower portion of the outer circumferential surface adjacent to the bottom.

According to an embodiment of the disclosure, an upper end of the secondary oil passage may be formed below an upper end of the secondary oil pump.

According to an embodiment of the disclosure, the upper end of the secondary oil passage is formed to correspond to the communication hole.

According to an embodiment of the disclosure, an upper end of the secondary oil pump is adjacent to a lower surface of the rotor and is located above a surface of the oil contained in the oil reservoir.

According to an embodiment of the disclosure, the oil contained in the oil reservoir flows into the secondary oil pump through an upper portion of the secondary oil pump. The oil flowing into the secondary oil pump moves to a lower end of the drive shaft along the secondary oil passage, and then moves to the upper portion of the cavity of the drive shaft along the primary oil passage.

According to an embodiment of the disclosure, the secondary oil passage is formed as a helical groove formed on the outer circumferential surface of the lower portion of the drive shaft inserted into the secondary oil pump. A helical direction of the helical groove of the secondary oil passage is opposite to a helical direction of the first oil supply passage.

According to an embodiment of the disclosure, the secondary oil passage is formed as a helical groove formed on the inner circumferential surface of the secondary oil pump. A helical direction of the helical groove of the secondary oil passage is identical to a helical direction of the first oil supply passage.

According to an embodiment of the disclosure, the secondary oil pump includes at least one oil inlet formed on the outer circumferential surface adjacent to the upper end of the secondary oil pump.

According to an embodiment of the disclosure, the upper end of the secondary oil passage is formed at the upper end of the secondary oil pump.

According to an embodiment of the disclosure, an upper end of the secondary oil pump is adjacent to a lower surface of the rotor and is located below a surface of the oil contained in the oil reservoir.

According to an embodiment of the disclosure, a coupling hole to which the primary oil pump is coupled is formed at the bottom of the secondary oil pump.

According to an embodiment of the disclosure, the coupling hole may be formed in one of a circular, polygonal, and oval shape.

According to an embodiment of the disclosure, the primary oil pump and the secondary oil pump may be coupled by screw coupling or press-fit coupling.

According to an embodiment of the disclosure, a gap between an inner circumferential surface of the secondary oil pump and an outer circumferential surface of a lower portion of the drive shaft is 0.1 mm to 0.15 mm.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION OF THE EMBODIMENTS

Figure 1:
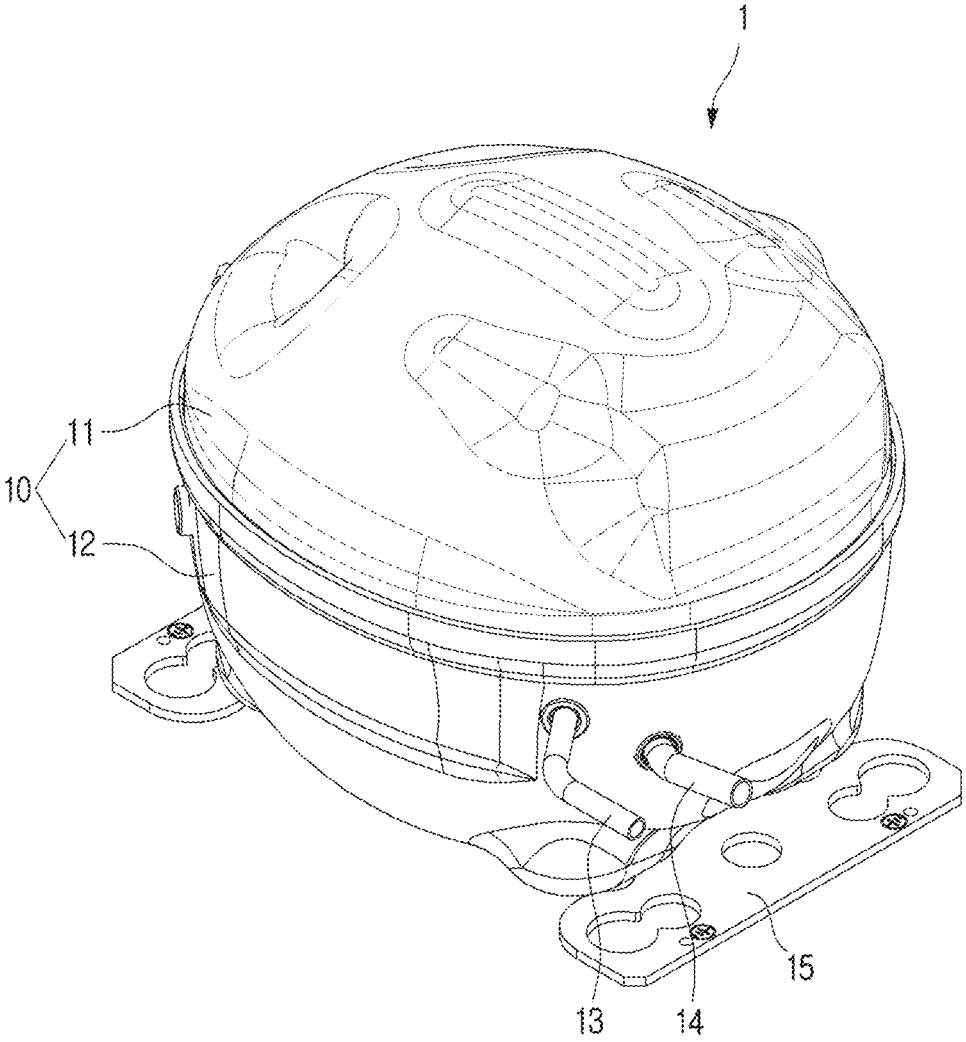
FIG. 1 is a perspective view illustrating a reciprocating compressor according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In connection with the description of the drawings, similar reference numbers may be used for similar or related components.

The singular form of a noun corresponding to an item may include one or more of the above item, unless the relevant context clearly indicates otherwise.

In this document, each of phrases such as "A or B," "at least one of A and B," "at least one of A or B," "A, B, or C," "at least one of A, B, and C," "at least one of A, B, C" may include any one of the items listed together with the corresponding phrase, or any possible combination thereof.

The term "and/or" includes any element of a plurality of related described elements or a combination of a plurality of related described elements.

Terms such as "first," "second," "primary," or "secondary" may be used simply to distinguish one component from other components, and do not limit the corresponding components in other respects (e.g., importance or order).

When it is mentioned that one (e.g., first) component is "coupled" or "connected" to another (e.g., second) component with or without terms "functionally" or "communicatively", it means that the one component can be connected to the another component directly (e.g., wired), wirelessly, or through a third component.

Terms such as "include" or "have" are intended to designate the presence of features, numbers, steps, operations, components, parts, or combinations thereof described in the embodiment, but do not preclude the presence or addition of one or more other features, numbers, steps, operations, components, parts, or combination thereof.

When a component is said to be "connected," "coupled," "supported," or "in contact" with another component, this means not only cases where the components are directly connected, coupled, supported, or contacted, but also cases where the components are indirectly connected, coupled, supported, or contacted through a third component.

When a component is said to be located "on" other component, this includes not only cases where the component is in contact with the other component, but also cases where another component exits between the two components.

Further, the terms 'leading end', 'rear end', 'upper side', 'lower side', 'top end', 'bottom end', etc. used in the disclosure are defined with reference to the drawings. However, the shape and position of each component are not limited by the terms.

The disclosure relates to a sealed reciprocating compressor 1 that can increase the amount of oil supplied to internal components compared to the reciprocating compressor according to the prior art when the reciprocating compressor operates at a low speed.

Hereinafter, a reciprocating compressor 1 according to an embodiment of the disclosure will be described in detail with reference to the attached drawings.

FIG. 1 is a perspective view illustrating a reciprocating compressor according to an embodiment of the disclosure.

Referring to FIG. 1, a reciprocating compressor 1 according to an embodiment of the disclosure may include a case 10.

The case 10 forms the exterior of the reciprocating compressor 1. The case 10 is formed as a sealed container. The case 10 may include a refrigerant inlet pipe 13 through which refrigerant flows in and a refrigerant discharge pipe 14 through which refrigerant is discharged.

The reciprocating compressor 1 may form a refrigeration cycle with a condenser, an expansion valve, and an evaporator. In this case, the refrigerant inlet pipe 13 may be connected to the evaporator, and the refrigerant discharge pipe 14 may be connected to the condenser.

The case 10 may include an upper case 11 and a lower case 12. The upper case 11 is coupled to the upper end of the lower case 12 to form the case 10.

The joint portion of the upper case 11 and the lower case 12 is hermetic.

The lower case 12 is provided with the refrigerant inlet pipe 13 and the refrigerant discharge pipe 14. The refrigerant inlet pipe 13 and the refrigerant discharge pipe 14 communicate with a compression part 40 (see FIG. 2) disposed inside the case 10. Low-temperature and low-pressure refrigerant may flow into the refrigerant inlet pipe 13. High-temperature and high-pressure refrigerant compressed in the compression part 40 may be discharged to the outside of the case 10 through the refrigerant discharge pipe 14.

A base 15 supporting the case 10 may be provided at the bottom of the lower case 12. The reciprocating compressor 1 may be disposed perpendicular to the support surface by the base 15.

Figure 2:
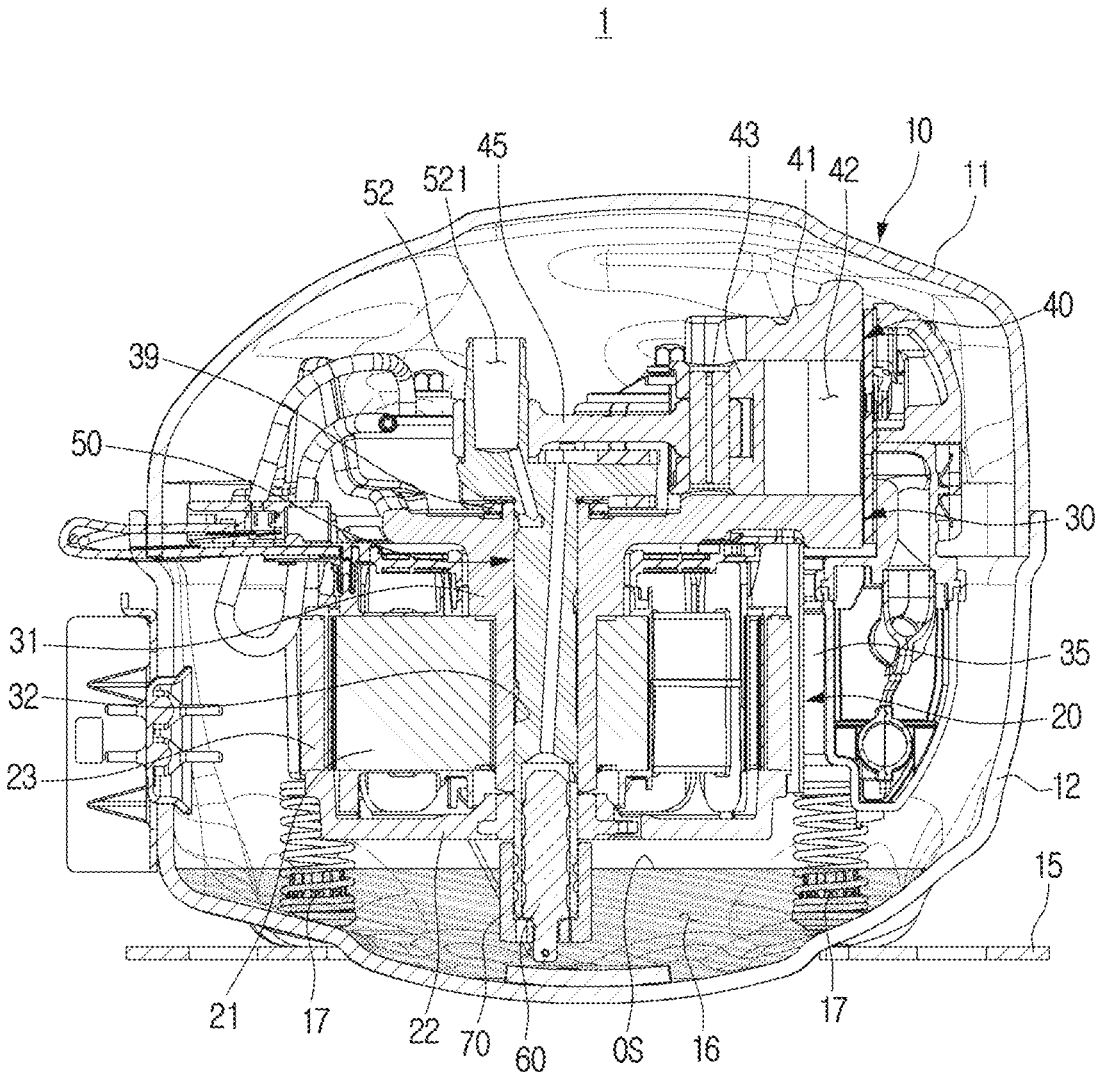
FIG. 2 is a cross-sectional view illustrating a reciprocating compressor according to an embodiment of the disclosure.
Figure 3:
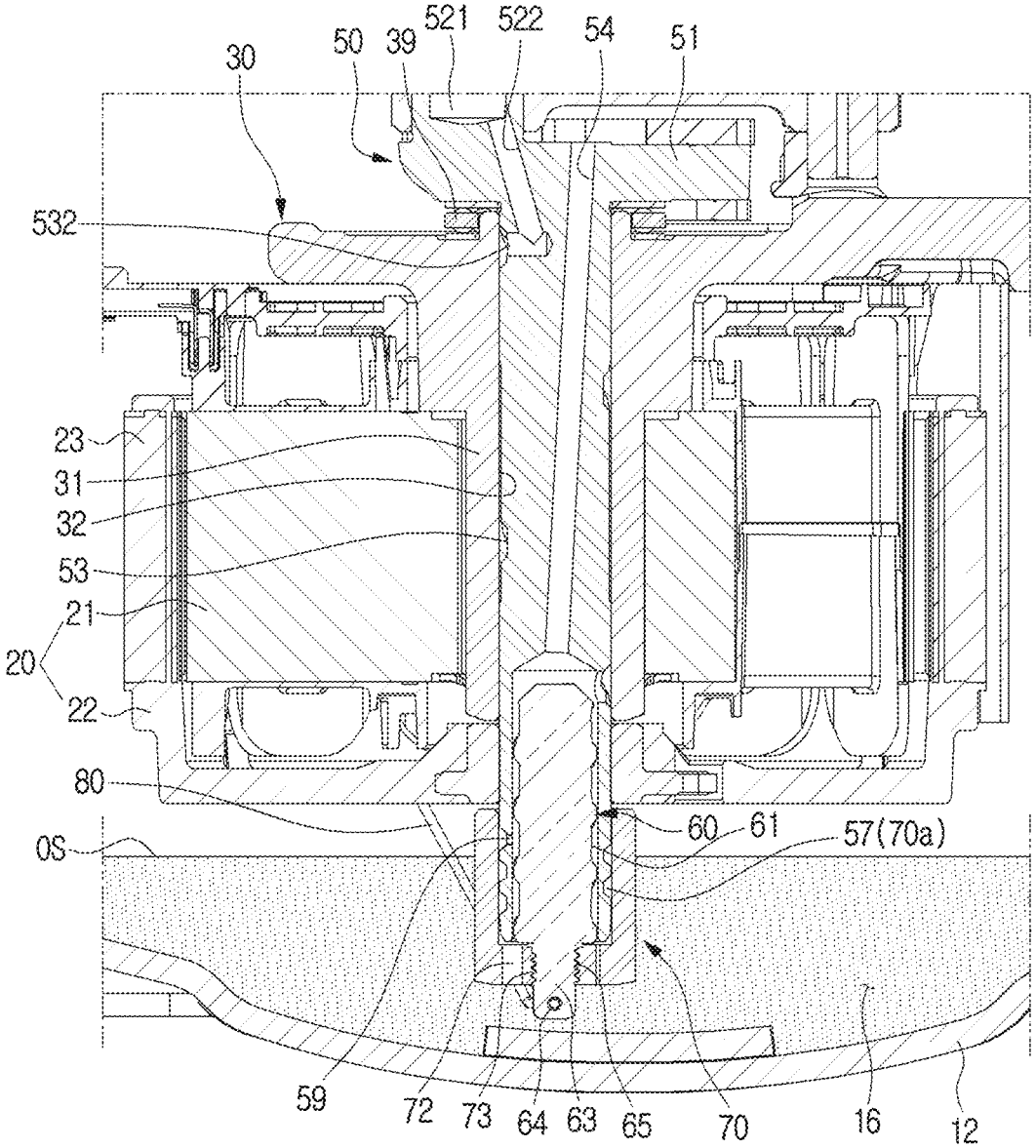
FIG. 3 is an enlarged partial cross-sectional view illustrating main components of the reciprocating compressor of FIG. 2 according to an embodiment of the disclosure.

FIG. 2 is a cross-sectional view illustrating a reciprocating compressor according to an embodiment of the disclosure. FIG. 3 is an enlarged partial cross-sectional view illustrating main components of the reciprocating compressor of FIG. 2 according to an embodiment of the disclosure.

Referring to FIGS. 2 and 3, the reciprocating compressor 1 according to an embodiment of the disclosure may include a case 10 and a motor 20.

The case 10 forms the exterior of the reciprocating compressor 1 and may be formed as a hermetic container. The motor 20 may be disposed inside the case 10. The case 10 may include a lower case 12 and an upper case 11 covering the upper side of the lower case 12.

The case 10 is formed by coupling the upper case 11 and the lower case 12, and the inside of the case 10 except the refrigerant inlet pipe 13 and the refrigerant discharge pipe 14 may be hermetic. In other words, the refrigerant may flow into the inside of the case 10 only through the refrigerant inlet pipe 13, and may be discharged to the outside of the case 10 only through the refrigerant discharge pipe 14.

An oil reservoir 16 containing oil or lubricating oil (hereinafter referred to as oil) may be provided in the lower portion of the lower case 12.

The motor 20 is disposed inside the case 10 and includes a stator 21 and a rotor 22. The stator 21 is disposed to be fixed to the case 10. The rotor 22 may be disposed to rotate with respect to the stator 21.

In this embodiment, the rotor 22 is disposed outside the stator 21. That is, the stator 21 is disposed inside the rotor 22. Accordingly, the rotor 22 may rotate around the stator 21 outside of the stator 21. As another embodiment, the rotor 22 may be rotatably disposed inside the stator 21.

The reciprocating compressor 1 may further include a bearing block 30 and a compression part 40.

The bearing block 30 is disposed inside the case 10. The motor 20 may be disposed at the lower side of the bearing block 30, and the compression part 40 may be disposed at the upper side of the bearing block 30.

The bearing block 30 may be disposed at the bottom of the lower case 12. The bearing block 30 may be supported by a pair of elastic supporters 17 disposed at the bottom of the lower case 12.

The bearing block 30 may include a fixed shaft 31. The fixed shaft 31 may be formed to extend vertically downward from the lower surface of the bearing block 30. The fixed shaft 31 may be formed in a cylindrical shape.

A shaft hole 32 may be formed inside the fixed shaft 31. The shaft hole 32 may be formed to have a circular cross-section. The shaft hole 32 is formed to penetrate the fixed shaft 31 and the bearing block 30 vertically.

The stator 21 is disposed on the outer circumferential surface of the fixed shaft 31, and a drive shaft 50 is inserted into the shaft hole 32 of the fixed shaft 31.

The inner circumferential surface of the shaft hole 32 is surface processed to function as a bearing that supports the rotation of the drive shaft 50. Therefore, the drive shaft 50 may rotate relative to the fixed shaft 31 while inserted into the shaft hole 32.

The bearing block 30 may include a pair of legs 35 extending downward from the lower surface thereof. The pair of legs 35 may be formed symmetrically about the fixed shaft 31. In other words, the fixed shaft 31 may be formed between the pair of legs 35.

The lower surfaces of the pair of legs 35 may be supported by the pair of elastic supporters 17. The upper end of the elastic supporter 17 may be fixed to the lower surface of the leg 35, and the lower end of the elastic supporter 17 may be fixed to the bottom of the lower case 12. Each of the pair of elastic supporters 17 may be formed as a coil spring.

The motor 20 may be disposed below the bearing block 30. The motor 20 may be configured to generate a rotational force to operate the compression part 40. The motor 20 may include the stator 21 and the rotor 22.

The stator 21 may be fixed to the lower surface of the bearing block 30. The stator 21 may include a stator core and a coil. The stator core may be formed by stacking pressed steel plates.

The rotor 22 is disposed outside the stator 21. In other words, the stator 21 is disposed inside the rotor 22. Accordingly, the rotor 22 may rotate around the stator 21 outside of the stator 21.

The rotor 22 may be formed in a cylindrical container shape. In other words, the rotor 22 may be formed in a hollow cylindrical shape with the lower end closed and the upper end open. The stator 21 may be accommodated inside the rotor 22. A plurality of permanent magnets 23 are disposed on the outer circumferential surface of the rotor 22. The plurality of permanent magnets 23 may be arranged at regular intervals in the circumferential direction of the rotor 22.

The compression part 40 is formed to compress and discharge the refrigerant introduced through the refrigerant inlet pipe 13. The compression part 40 may be provided on the upper surface of the bearing block 30.

The compression part 40 may include a cylinder block 41, a piston 43, and a connecting rod 45.

The cylinder block 41 is formed on the upper surface of the bearing block 30. A compression chamber 42 having a circular cross-section is formed inside the cylinder block 41. An inlet valve and a discharge valve are provided at the outer end of the cylinder block 41.

The piston 43 is inserted into the compression chamber 42 of the cylinder block 41. The piston 43 is formed to linearly reciprocate a certain distance along the inner surface of the compression chamber 42 of the cylinder block 41.

The piston 43 is connected to one end of the connecting rod 45. The other end of the connecting rod 45 is connected to the crank shaft 52 of the drive shaft 50. Accordingly, when the drive shaft 50 rotates, the piston 43 may linearly reciprocate in the compression chamber 42 of the cylinder block 41 by the crank shaft 52 and the connecting rod 45. In other words, the rotational motion of the drive shaft 50 may be converted into the linear reciprocating motion of the piston 43 by the connecting rod 45 and the crank shaft 52 of the drive shaft 50.

When the piston 43 linearly reciprocates in the compression chamber 42 of the cylinder block 41, the refrigerant may flow into the compression chamber 42 through the inlet valve, may be compressed, and then may be discharged to the outside of the compression chamber 42 through the discharge valve.

Referring to FIGS. 2 and 3, the drive shaft 50 may be fixed to the center of the rotor 22. Accordingly, when the rotor 22 rotates, the drive shaft 50 may rotate integrally with the rotor 22.

The drive shaft 50 is inserted into the shaft hole 32 of the fixed shaft 31 of the bearing block 30. The drive shaft 50 is rotatably supported by the shaft hole 32. Accordingly, when the rotor 22 rotates, the drive shaft 50 may rotate inside the shaft hole 32 of the fixed shaft 31.

A head portion 51 is provided at the upper end of the drive shaft 50. The head portion 51 is formed to have a diameter larger than the diameter of the drive shaft 50. The head portion 51 is formed to rotate integrally with the drive shaft 50.

A bearing 39 is disposed between the head portion 51 and the upper surface of the bearing block 30. Accordingly, when the drive shaft 50 rotates, the head portion 51 may rotate with respect to the upper surface of the bearing block 30.

The crank shaft 52 is provided on the upper surface of the head portion 51. The crank shaft 52 is formed perpendicular to the upper surface of the head portion 51. The crank shaft 52 is formed to be eccentric with the drive shaft 50. In other words, the center line of the drive shaft 50 is spaced apart from the center line of the crank shaft 52 by a predetermined distance. The connecting rod 45 may be connected to the crank shaft 52.

An oil groove 521 may be formed at the top of the crank shaft 52. The oil groove 521 may be formed at a predetermined depth on the upper surface of the crank shaft 52.

The lower end of the drive shaft 50 may protrude below the rotor 22 and may be submerged in the oil contained in the oil reservoir 16.

The reciprocating compressor 1 may include a primary oil pump 60 and a secondary oil pump 70. The primary oil pump 60 and the secondary oil pump 70 are disposed at the lower portion of the drive shaft 50 and are configured to pump oil contained in the oil reservoir 16 of the case 10. The primary oil pump 60 and the secondary oil pump 70 are disposed at the lower portion of the drive shaft 50 protruding below the rotor 22.

The drive shaft 50, the primary oil pump 60, and the secondary oil pump 70 may form a drive shaft assembly.

Hereinafter, the drive shaft assembly according to an embodiment of the disclosure will be described in detail with reference to FIGS. 4, 5, 6, and 7.

Figure 4:
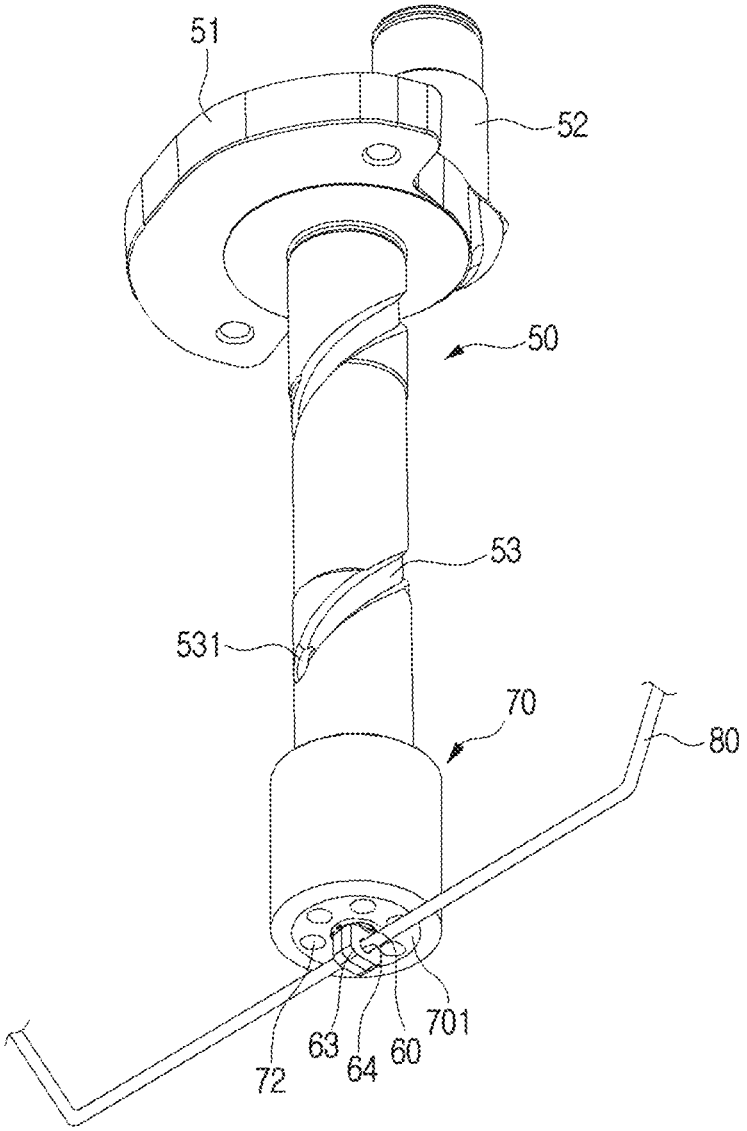
FIG. 4 is a perspective view illustrating a drive shaft assembly of a reciprocating compressor according to an embodiment of the disclosure.
Figure 5:
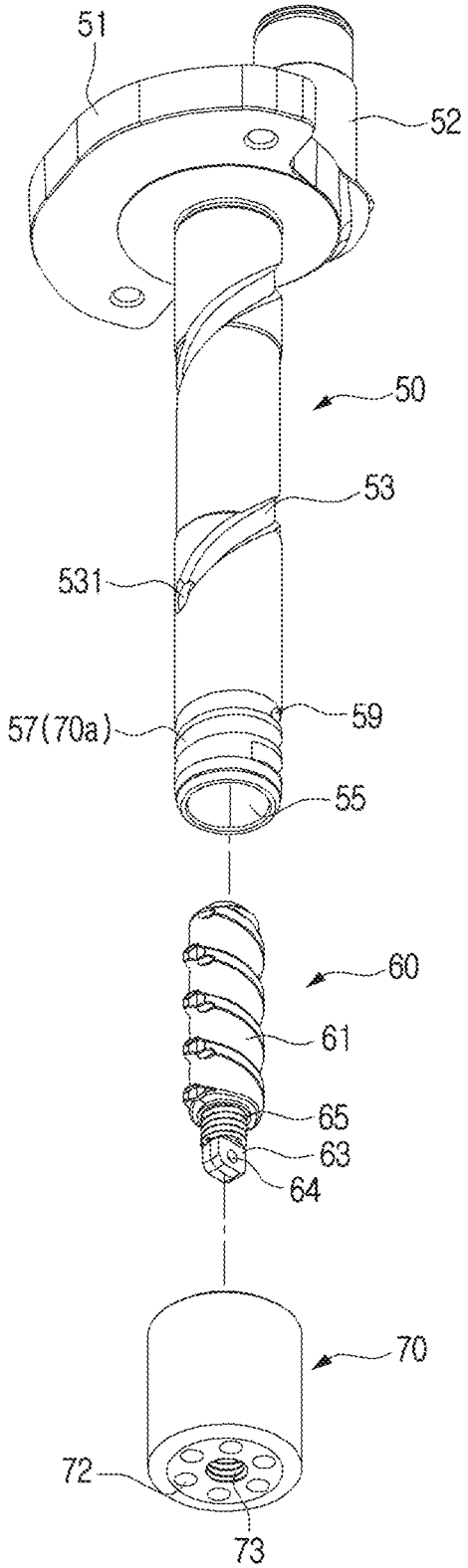
FIG. 5 is an exploded perspective view illustrating the drive shaft assembly of FIG. 4 according to an embodiment of the disclosure.
Figure 6:
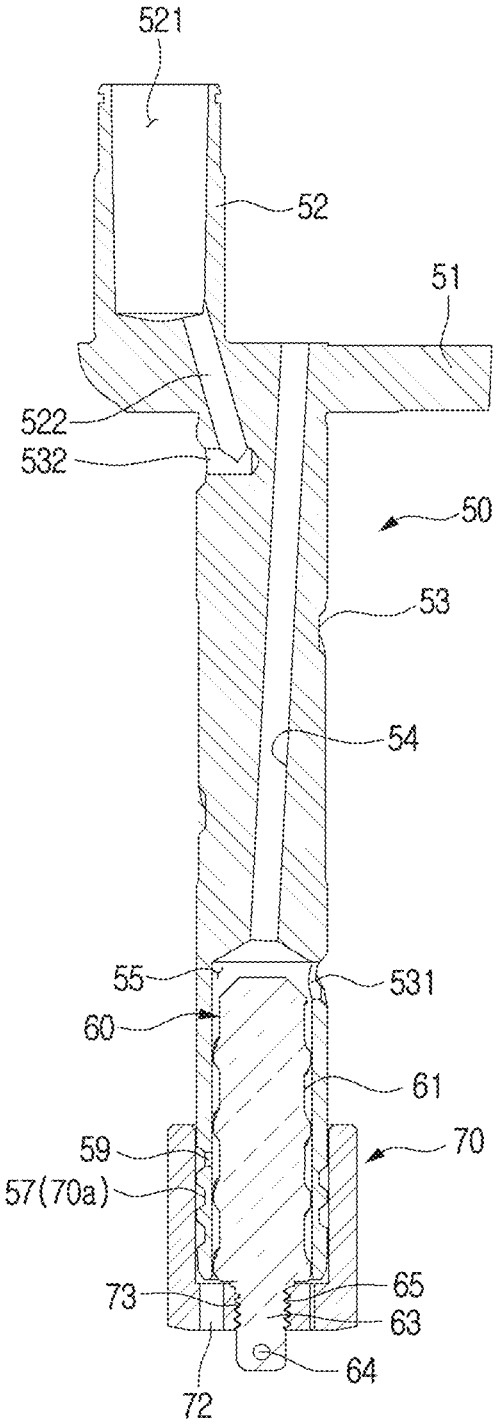
FIG. 6 is a cross-sectional view illustrating the drive shaft assembly of FIG. 4 according to an embodiment of the disclosure.
Figure 7:
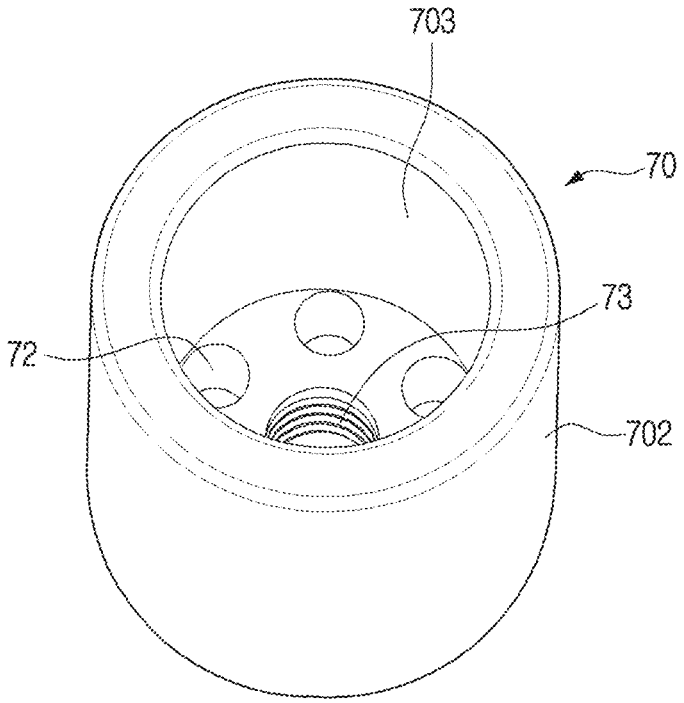
FIG. 7 is a perspective view illustrating a secondary oil pump of the drive shaft assembly of FIG. 4 according to an embodiment of the disclosure.

FIG. 4 is a perspective view illustrating a drive shaft assembly of a reciprocating compressor 1 according to an embodiment of the disclosure. FIG. 5 is an exploded perspective view illustrating the drive shaft assembly of FIG. 4 according to an embodiment of the disclosure. FIG. 6 is a cross-sectional view illustrating the drive shaft assembly of FIG. 4 according to an embodiment of the disclosure. FIG. 7 is a perspective view illustrating a secondary oil pump 70 of the drive shaft assembly of FIG. 4 according to an embodiment of the disclosure.

Referring to FIGS. 4, 5, 6, and 7, the drive shaft assembly may include the drive shaft 50, the primary oil pump 60, and the secondary oil pump 70.

The drive shaft 50 is formed to rotate integrally with the rotor 22 of the motor 20 to operate the compression part 40.

The primary oil pump 60 and the secondary oil pump 70 may be disposed at the lower portion of the drive shaft 50. The lower portion of the drive shaft 50 where the primary oil pump 60 and the secondary oil pump 70 are disposed is integrally with coupled with the rotor 22. In detail, the portion of the drive shaft 50 above the secondary oil pump 70 disposed at the lower portion of the drive shaft 50 is integrally coupled with the rotor 22. The primary oil pump 60 and the secondary oil pump 70 form a dual oil pump that pumps the oil contained in the oil reservoir 16.

The drive shaft 50 may include a cavity 55, a first oil supply passage 53 and a second oil supply passage 54.

The cavity 55 may be formed at the bottom of the drive shaft 50. The cavity 55 may be formed at a predetermined depth on the lower surface of the drive shaft 50. The cavity 55 may be formed as a hole with a circular cross-section. The primary oil pump 60 may be inserted into the cavity 55.

Hereinafter, the portion of the drive shaft 50 where the cavity 55 is formed is referred to as the lower portion of the drive shaft 50, and the portion of the drive shaft 50 above the cavity 55, that is, the portion of the drive shaft 50 between the cavity 55 and the head portion 51 is referred to as the upper portion of the drive shaft 50.

The first oil supply passage 53 may be formed as a helical groove on the outer circumferential surface of the drive shaft 50. The first oil supply passage 53 may be formed as a groove having a certain width and depth on the outer circumferential surface of the upper portion of the drive shaft 50.

A first oil inlet 531 may be formed at the lower end of the first oil supply passage 53. The first oil inlet 531 may penetrate the outer circumferential surface of the drive shaft 50 and communicate with the cavity 55. The first oil inlet 531 may be formed adjacent to the top of the cavity 55. Accordingly, oil in the cavity 55 may flow into the first oil supply passage 53 through the first oil inlet 531.

A first oil outlet 532 may be formed at the upper end of the first oil supply passage 53. The first oil outlet 532 is connected to the oil passage 522 formed at the bottom of the oil groove 521 of the crank shaft 52. Accordingly, the first oil supply passage 53 is connected to the oil groove 521 of the crank shaft 52 through the first oil outlet 532 and the oil passage 522.

The oil passage 522 is formed to be inclined with respect to the longitudinal direction of the crank shaft 52. Because the oil passage 522 is inclined, when the drive shaft 50 rotates, oil may move to the oil groove 521 of the crank shaft 52 by centrifugal force.

The second oil supply passage 54 is formed to penetrate the drive shaft 50 vertically. In detail, the second oil supply passage 54 is formed to communicate with the upper end of the cavity 55 and the upper surface of the head portion 51. The second oil supply passage 54 is formed to be inclined with respect to the longitudinal direction of the drive shaft 50. Because the second oil supply passage 54 is formed to be inclined, when the drive shaft 50 rotates, the oil in the cavity 55 may move to the upper side of the head portion 51 due to centrifugal force.

The primary oil pump 60 may be disposed at the lower portion of the drive shaft 50. In detail, the primary oil pump 60 is disposed so that the upper portion of the primary oil pump 60 is inserted into the cavity 55 of the drive shaft 50 and the lower portion of the primary oil pump 60 is submerged in oil in the oil reservoir 16.

The primary oil pump 60 may be formed in a cylindrical shape. The diameter of the primary oil pump 60 is formed to be smaller than the diameter of the cavity 55. Accordingly, a certain gap is provided between the primary oil pump 60 and the inner circumferential surface of the cavity 55 of the drive shaft 50. For example, the gap of 0.1 mm to 0.15 mm may be formed between the outer circumferential surface of the primary oil pump 60 and the inner circumferential surface of the cavity 55 of the drive shaft 50.

A helical groove 71 may be formed on the outer circumferential surface of the primary oil pump 60. This helical groove 71 forms the primary oil passage 61. Accordingly, a helical-shaped primary oil passage 61 is provided between the primary oil pump 60 and the cavity 55 of the drive shaft 50. Therefore, when the drive shaft 50 rotates, oil in the oil reservoir 16 moves upward along the primary oil passage 61 by the viscous friction force with the inner circumferential surface of the cavity 55 of the rotating drive shaft 50.

The helical direction of the helical groove of the primary oil passage 61 may be formed in a direction opposite to the helical direction of the first oil supply passage 53 of the drive shaft 50.

The primary oil pump 60 may include a coupling protrusion 63. The coupling protrusion 63 may be formed to protrude from the lower surface of the primary oil pump 60. The coupling protrusion 63 may be formed in a cylindrical shape. A screw thread 65 may be formed on the outer circumferential surface of the coupling protrusion 63. In other words, the coupling protrusion 63 may be formed as a male screw.

A through hole 64 through which a metal wire 80 penetrates may be formed in the coupling protrusion 63. Both ends of the metal wire 80 may be fixed to the lower case 12. Because the metal wire 80 is fixed to the lower case 12, the primary oil pump 60 coupled to the metal wire 80 is fixed to the case 10. Therefore, when the drive shaft 50 rotates, the primary oil pump 60 does not rotate and remains fixed.

The secondary oil pump 70 is disposed at the lower portion of the drive shaft 50. The secondary oil pump 70 may be disposed outside the primary oil pump 60. That is, the secondary oil pump 70 may be disposed to surround the primary oil pump 60. The secondary oil pump 70 may be disposed concentrically with the primary oil pump 60. A secondary oil passage 70*a* is formed between the outer circumferential surface of the lower portion of the drive shaft 50 and the secondary oil pump 70.

The secondary oil passage 70*a* may be formed as a helical groove 57. The diameter of the helical groove 57 forming the secondary oil passage 70*a* is larger than the diameter of the helical groove forming the primary oil passage 61 of the primary oil pump 60. The secondary oil passage 70*a* may be formed around the primary oil passage 61.

The secondary oil passage 70*a* may be formed as the helical groove 57 formed on the outer circumferential surface of the lower portion of the drive shaft 50. The helical groove 57 may be formed to have a certain length from the lower end of the drive shaft 50.

The helical direction of the helical groove 57 of the secondary oil passage 70*a* formed on the outer circumferential surface of the lower portion of the drive shaft 50 is formed to be identical to the helical direction of the first oil supply passage 53 formed on the outer circumferential surface of the upper portion of the drive shaft 50. Accordingly, when the drive shaft 50 rotates, oil in the oil reservoir 16 moves upward along the helical groove 57 of the rotating drive shaft 50, that is, the secondary oil passage 70*a*, by the viscous friction force.

The lower end portion of the drive shaft 50 is inserted into the secondary oil pump 70, and the secondary oil pump 70 is formed to be coupled to the primary oil pump 60. Because the primary oil pump 60 is fixed to the case 10, when the secondary oil pump 70 is coupled to the primary oil pump 60, the secondary oil pump 70 is fixed to the case 10. Therefore, when the drive shaft 50 rotates, the secondary oil pump 70 does not rotate.

The drive shaft 50 may include a communication hole 59. The communication hole 59 is formed to communicate the cavity 55 with the outer circumferential surface of the lower portion of the drive shaft 50. In other words, the communication hole 59 may be formed in the lower portion of the drive shaft 50 to communicate the primary oil passage 61 and the secondary oil passage 70*a*. The communication hole 59 may be formed on the outer circumferential surface of the drive shaft 50 below the first oil inlet 531 of the first oil supply passage 53.

The upper end of the secondary oil passage 70*a* may be formed below the upper end of the secondary oil pump 70. When the upper end of the secondary oil passage 70*a* is located above the upper end of the secondary oil pump 70, oil supplied by the secondary oil pump 70 may leak out. Accordingly, the upper end of the secondary oil passage 70*a* is located below the upper end of the secondary oil pump 70.

The upper end of the secondary oil passage 70*a* may be formed to correspond to the communication hole 59. That is, the communication hole 59 is formed at a position corresponding to the upper end of the secondary oil passage 70*a* so that the oil supplied through the secondary oil passage 70*a* may flow into the cavity 55 of the drive shaft 50 through the communication hole 59. Accordingly, the communication hole 59 is located below the upper end of the secondary oil pump 70.

Referring to FIGS. 2 and 3, the secondary oil pump 70 is disposed at the lower end portion of the drive shaft 50. The secondary oil pump 70 may be disposed so that the upper end of the secondary oil pump 70 is adjacent to the lower surface of the rotor 22. At this time, the secondary oil pump 70 may be disposed as close to the lower surface of the rotor 22 as possible without contacting the lower surface of the rotor 22 so as not to interfere with the rotation of the rotor 22. The secondary oil pump 70 is disposed to be submerged in the oil contained in the oil reservoir 16 at the lower portion of the case 10. At this time, the secondary oil pump 70 is disposed so that the upper end of the secondary oil pump 70 is located above the surface operating system (OS) of the oil contained in the oil reservoir 16, that is, the oil surface.

Accordingly, the communication hole 59 of the drive shaft 50 may be located below the rotor 22. In addition, the secondary oil passage 70*a* of the secondary oil pump 70 may be located below the rotor 22.

The secondary oil pump 70 may be formed in the shape of a cylindrical shape with a bottom. That is, the secondary oil pump 70 may be formed in a hollow cylindrical shape with an open top and a closed bottom.

The inner diameter of the secondary oil pump 70 is larger than the outer diameter of the drive shaft 50. For example, the gap between the inner circumferential surface of the secondary oil pump 70 and the outer circumferential surface of the drive shaft 50 may be 0.1 mm to 0.15 mm.

A coupling hole 73 may be formed in the bottom 701 of the secondary oil pump 70. The coupling hole 73 may be formed at the center of the bottom 701 of the secondary oil pump 70.

The coupling hole 73 is formed to be coupled to the coupling protrusion 63 of the primary oil pump 60. The coupling hole 73 may be formed with a female screw. That is, a female screw corresponding to the male screw 65 of the coupling protrusion 63 of the primary oil pump 60 may be formed on the inner circumferential surface of the coupling hole 73. Accordingly, the coupling protrusion 63 of the primary oil pump 60 may be screwed to the coupling hole 73 of the secondary oil pump 70.

The secondary oil pump 70 may include a plurality of oil inlets 72. The plurality of oil inlets 72 may be formed at the bottom 701 of the secondary oil pump 70. The plurality of oil inlets 72 may be formed around the coupling hole 73. The plurality of oil inlets 72 may be formed at regular intervals around the coupling hole 73.

When the secondary oil pump 70 is submerged in the oil contained in the oil reservoir 16, the oil in the oil reservoir 16 may flow into the internal space of the secondary oil pump 70 through the plurality of oil inlets 72.

Figure 8:
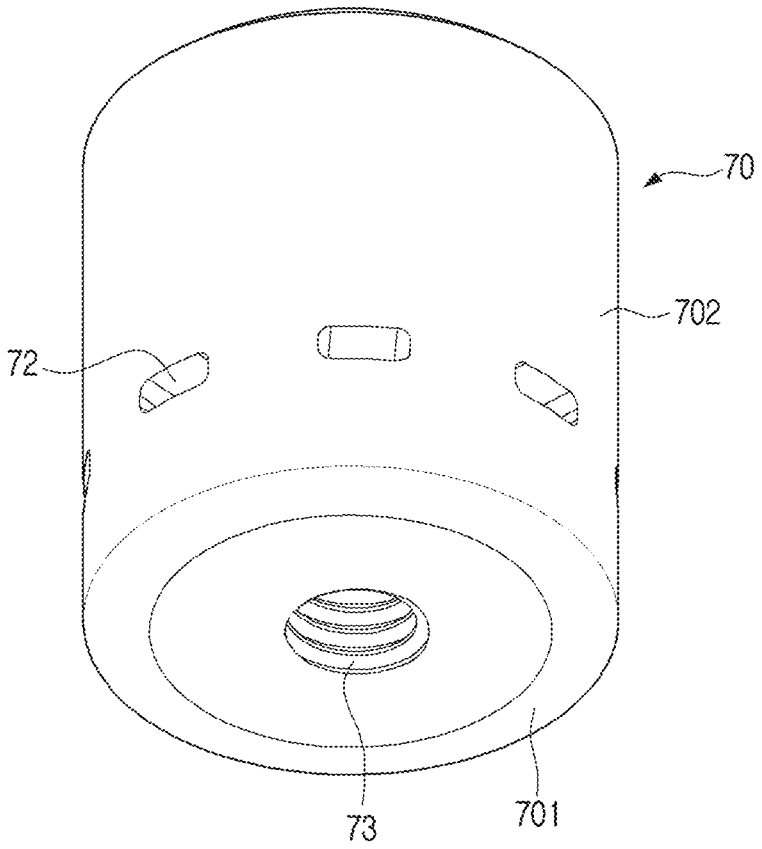
FIG. 8 is a perspective view illustrating a secondary oil pump of a reciprocating compressor according to an embodiment of the disclosure.

As another example, as illustrated in FIG. 8, the plurality of oil inlets 72 may be formed on the outer circumferential surface 702 of the secondary oil pump 70.

FIG. 8 is a perspective view illustrating a secondary oil pump 70 of a reciprocating compressor 1 according to an embodiment of the disclosure.

Referring to FIG. 8, the secondary oil pump 70 may be formed in the shape of a cylindrical shape with a bottom. That is, the secondary oil pump 70 may be formed in a hollow cylindrical shape with an open top and a closed bottom.

A coupling hole 73 may be formed in the bottom 701 of the secondary oil pump 70. The coupling hole 73 may be formed at the center of the bottom 701 of the secondary oil pump 70.

The coupling hole 73 is formed to be coupled to the coupling protrusion 63 of the primary oil pump 60. The coupling hole 73 may be formed with a female screw. That is, a female screw corresponding to the male screw 65 of the coupling protrusion 63 of the primary oil pump 60 may be formed on the inner circumferential surface of the coupling hole 73. Accordingly, the coupling protrusion 63 of the primary oil pump 60 may be screwed to the coupling hole 73 of the secondary oil pump 70.

A plurality of oil inlets 72 may be formed on the outer circumferential surface 702 of the secondary oil pump 70. That is, the plurality of oil inlets 72 may be formed on the outer circumferential surface of the cylindrical container. The plurality of oil inlets 72 may be formed to penetrate the outer circumferential surface 702 and the inner circumferential surface 703 of the cylindrical container. The plurality of oil inlets 72 may be formed at regular intervals along the outer circumferential surface of the secondary oil pump 70.

The secondary oil pump 70 may be disposed so that the plurality of oil inlets 72 are submerged in the oil contained in the oil reservoir 16. When the secondary oil pump 70 is submerged in the oil in the oil reservoir 16, the oil in the oil reservoir 16 may flow into the internal space of the secondary oil pump 70 through the plurality of oil inlets 72.

Figure 9:
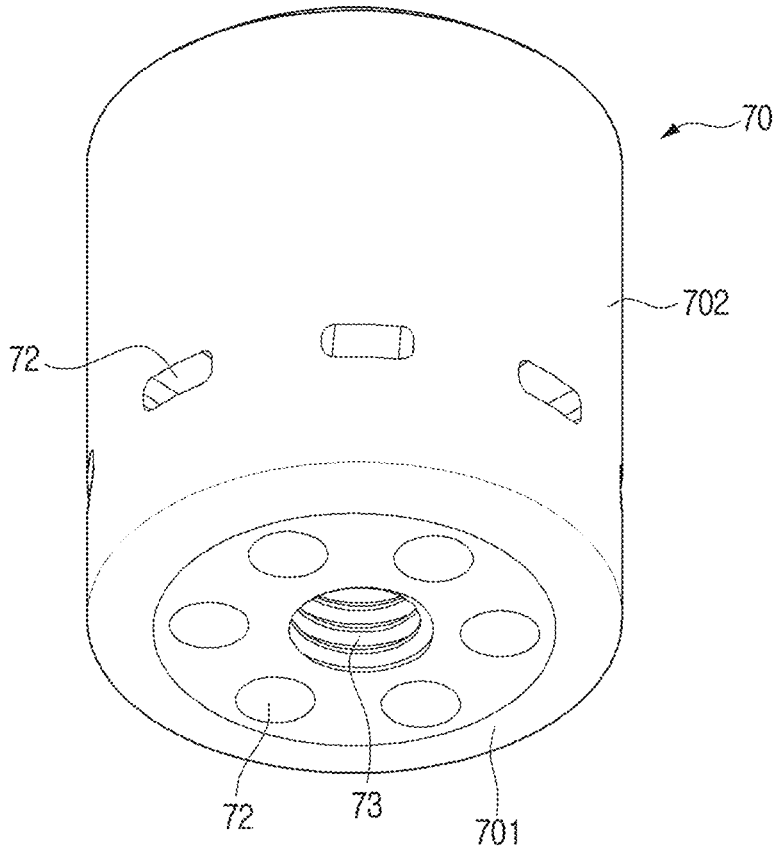
FIG. 9 is a perspective view illustrating a secondary oil pump of a reciprocating compressor according to an embodiment of the disclosure.

As another example, as illustrated in FIG. 9, the plurality of oil inlets 72 may be formed on the bottom 701 and the outer circumferential surface 702 of the secondary oil pump 70.

FIG. 9 is a perspective view illustrating a secondary oil pump 70 of a reciprocating compressor 1 according to an embodiment of the disclosure.

Referring to FIG. 9, the secondary oil pump 70 may be formed in the shape of a cylindrical shape with a bottom. That is, the secondary oil pump 70 may be formed in a hollow cylindrical shape with an open top and a closed bottom.

A coupling hole 73 may be formed in the bottom 701 of the secondary oil pump 70. The coupling hole 73 may be formed at the center of the bottom 701 of the secondary oil pump 70.

The coupling hole 73 is formed to be coupled to the coupling protrusion 63 of the primary oil pump 60. The coupling hole 73 may be formed with a female screw. That is, a female screw corresponding to the male screw 65 of the coupling protrusion 63 of the primary oil pump 60 may be formed on the inner circumferential surface of the coupling hole 73. Accordingly, the coupling protrusion 63 of the primary oil pump 60 may be screwed to the coupling hole 73 of the secondary oil pump 70.

The secondary oil pump 70 may include a plurality of oil inlets 72. The plurality of oil inlets 72 may be formed on the bottom 701 and outer circumferential surface 702 of the secondary oil pump 70.

In detail, some of the plurality of oil inlets 72 may be formed on the bottom 701 of the secondary oil pump 70. Some of the plurality of oil inlets 72 formed on the bottom 701 of the secondary oil pump 70 may be formed around the coupling hole 73. Some of the plurality of oil inlets 72 may be formed at regular intervals around the coupling hole 73.

The remainder of the plurality of oil inlets 72 may be formed on the outer circumferential surface 702 of the secondary oil pump 70. That is, the remaining plurality of oil inlets 72 may be formed on the outer circumferential surface of the cylindrical container. The remaining plurality of oil inlets 72 may be formed to penetrate the outer circumferential surface 702 and the inner circumferential surface 703 of the cylindrical container. The remaining plurality of oil inlets 72 may be formed at regular intervals along the outer circumferential surface of the secondary oil pump 70.

The secondary oil pump 70 may be disposed so that the plurality of oil inlets 72 are submerged in the oil contained in the oil reservoir 16. When the secondary oil pump 70 is submerged in the oil in the oil reservoir 16, the oil in the oil reservoir 16 may flow into the internal space of the secondary oil pump 70 through the plurality of oil inlets 72 formed on the bottom 701 and outer circumferential surface 702 of the secondary oil pump 70.

Hereinafter, oil supply by the reciprocating compressor 1 according to embodiment of the disclosure having the above structure will be described in detail with reference to FIGS. 2, 3, 4, 5, 6, 34, and 35.

Figure 34:
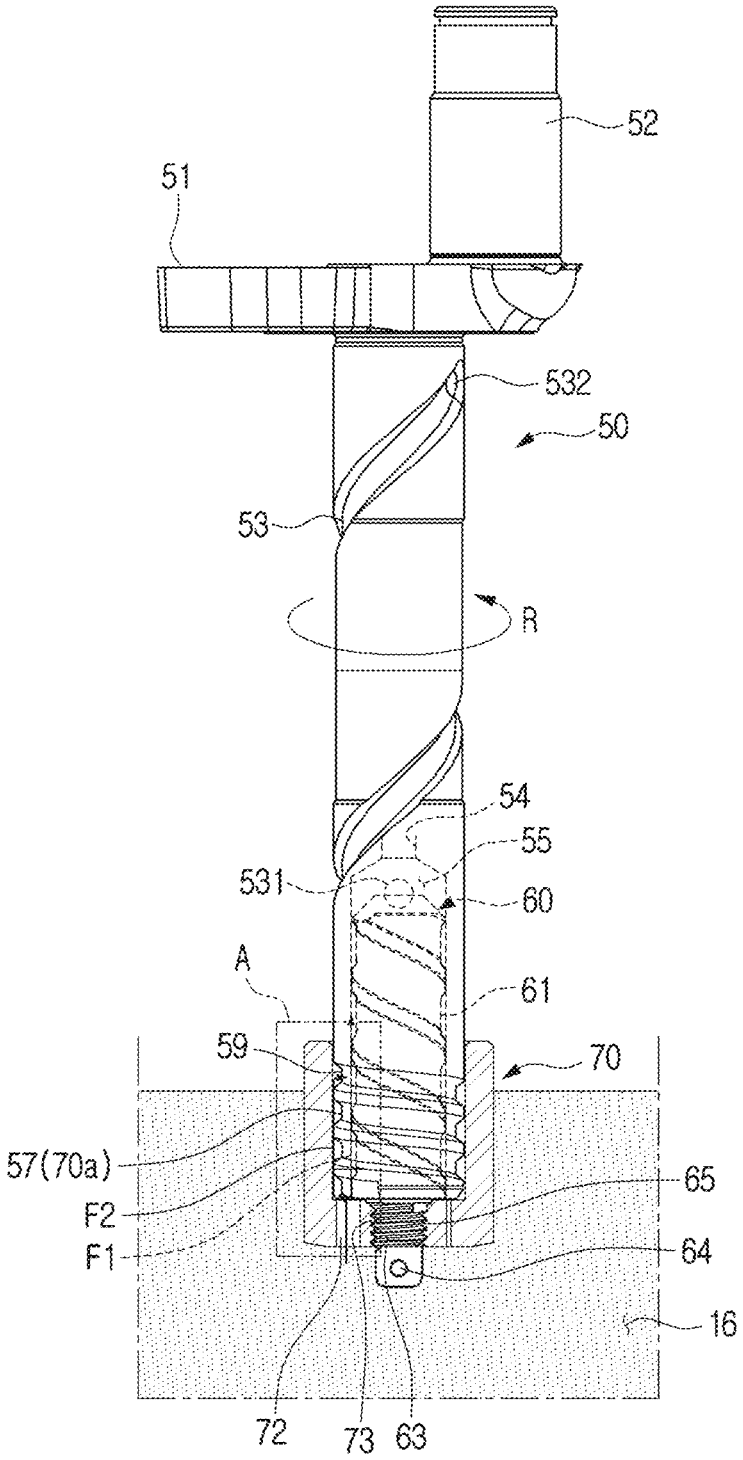
FIG. 34 is a view illustrating movement of oil by rotation of a drive shaft of a reciprocating compressor according to an embodiment of the disclosure.
Figure 35:
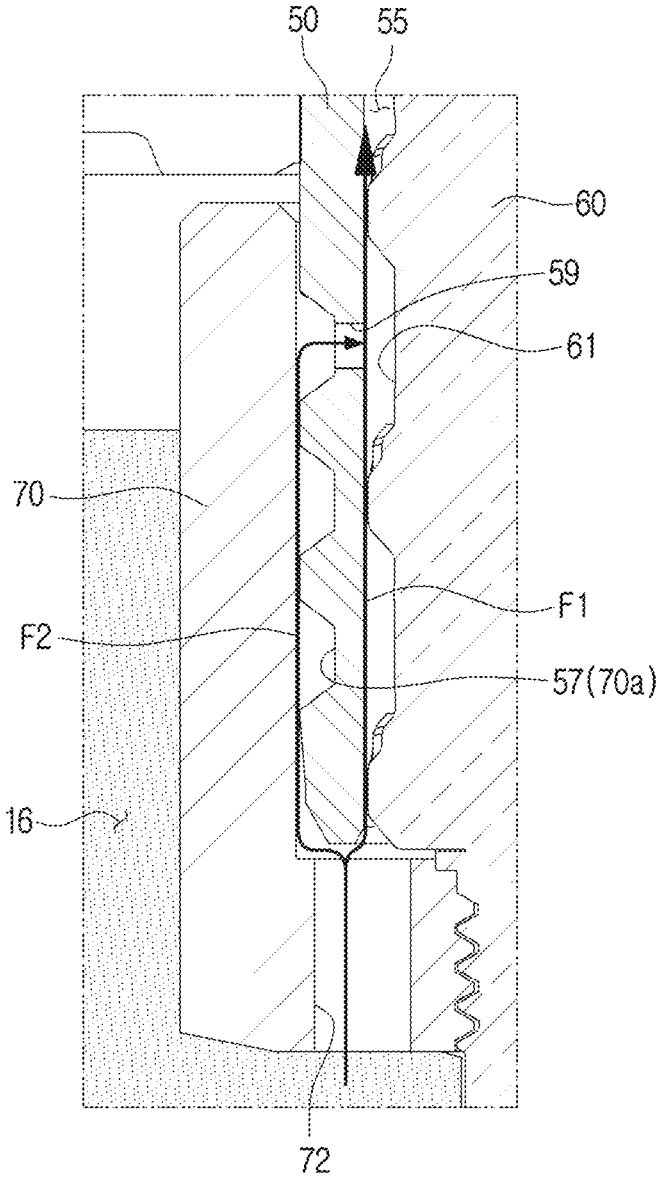
FIG. 35 is an enlarged cross-sectional view illustrating portion A of FIG. 34 according to an embodiment of the disclosure.

FIG. 34 is a view illustrating movement of oil by rotation of a drive shaft 50 of a reciprocating compressor 1 according to an embodiment of the disclosure. FIG. 35 is an enlarged cross-sectional view illustrating portion A of FIG. 34 according to an embodiment of the disclosure.

When the drive shaft 50 rotates integrally with the rotor 22, the oil contained in the oil reservoir 16 may be supplied to the upper side of the drive shaft 50 by the primary oil pump 60 and the secondary oil pump 70.

In detail, when the drive shaft 50 rotates in one direction R, the oil contained in the oil reservoir 16 may flow into the secondary oil pump 70 through the lower portion of the secondary oil pump 70. For example, the oil in the oil reservoir 16 may flow into the secondary oil pump 70 through the plurality of oil inlets 72 formed at the lower portion of the secondary oil pump 70.

Some of the oil flowing into the internal space of the secondary oil pump 70 may be supplied to the upper portion of the cavity 55 along the primary oil passage 61 formed between the primary oil pump 60 and the inner circumferential surface of the cavity 55 of the drive shaft 50 (see F1 in FIGS. 34 and 35).

In addition, the remainder of the oil flowing into the internal space of the secondary oil pump 70 may move upward along the secondary oil passage 70*a* formed between the inner circumferential surface of the secondary oil pump 70 and the outer circumferential surface of the drive shaft 50, and then may flow into the inside of the cavity 55 through the communication hole 59 (see F2 in FIGS. 34 and 35). At this time, because the helical direction of the helical groove 57 forming the secondary oil passage 70*a* formed on the outer circumferential surface of the lower portion of the drive shaft 50 is the same as the helical direction of the first oil supply passage 53 formed on the outer circumferential surface of the upper portion of the drive shaft 50, when the drive shaft 50 rotates, the oil flowing into the internal space of the secondary oil pump 70 moves upward along the secondary oil passage 70*a*.

The oil flowing into the cavity 55 through the communication hole 59 may move to the upper portion of the cavity 55 together with the oil moving along the primary oil passage 61.

Accordingly, when the drive shaft 50 rotates, the oil in the oil reservoir 16 may be supplied to the upper portion of the cavity 55 by the primary oil pump 60 and the secondary oil pump 70.

Some of the oil supplied to the upper portion of the cavity 55 moves to the first oil supply passage 53 through the first oil inlet 531. Some oil may be supplied between the outer circumferential surface of the drive shaft 50 and the inner circumferential surface of the fixed shaft 31 through the first oil supply passage 53. Some oil that has moved to the top of the first oil supply passage 53 may be supplied to the oil groove 521 of the crank shaft 52 through the first oil outlet 532 and the oil passage 522. The oil supplied to the oil groove 521 may be supplied to the crank shaft 52 and the connecting rod 45.

In addition, the remainder of the oil supplied to the upper portion of the cavity 55 may be supplied to the upper side of the drive shaft 50, that is, the upper surface of the head portion 51, through the second oil supply passage 54. The oil suppled to the upper surface of the head portion 51 may be supplied to the bearing 39 disposed in the head portion 51.

As described above, the reciprocating compressor 1 according to an embodiment of the disclosure, the oil in the oil reservoir 16 is supplied to the inner components by two oil pumps, that is, the primary oil pump 60 disposed inside the cavity 55 of the drive shaft 50 and the secondary oil pump 70 disposed outside the cavity 55 of the drive shaft 50. Therefore, when the reciprocating compressor 1 operates at a low speed, sufficient oil may be supplied to the inner components of the reciprocating compressor 1.

In the above description, the secondary oil passage 70*a* is formed on the outer circumferential surface of the drive shaft 50. However, as another embodiment, the secondary oil passage 70*a* may be formed on the inner circumferential surface of the secondary oil pump 70.

Hereinafter, the drive shaft assembly having this structure will be described in detail with reference to FIGS. 10, 11, 12, and 13.

Figure 10:
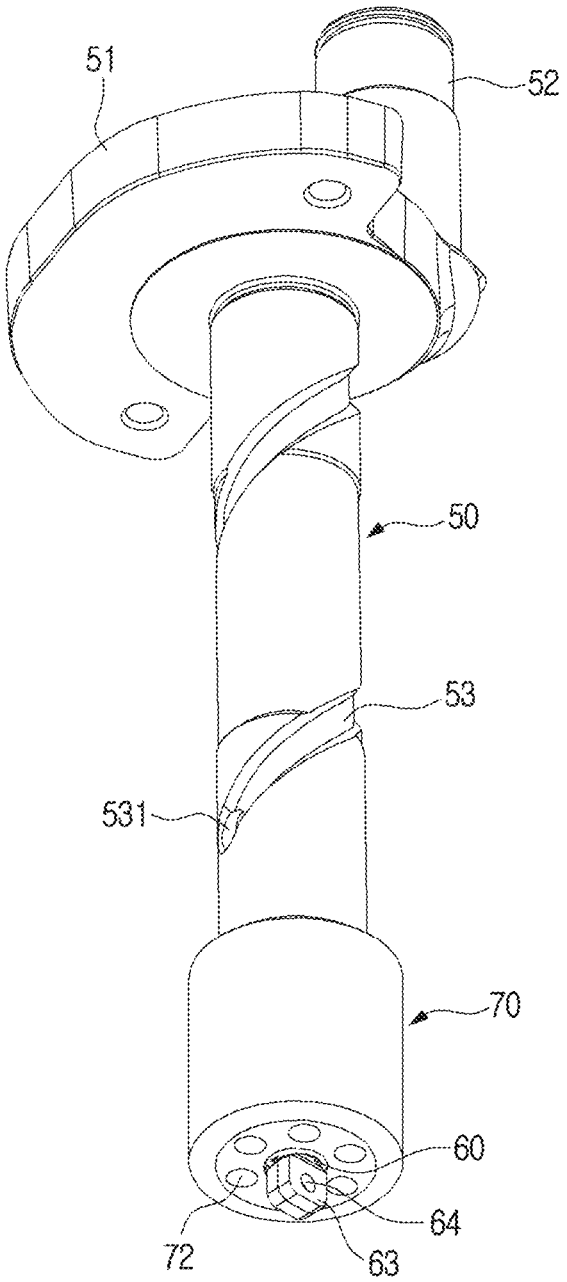
FIG. 10 is a perspective view illustrating a drive shaft assembly of a reciprocating compressor according to an embodiment of the disclosure.
Figure 11:
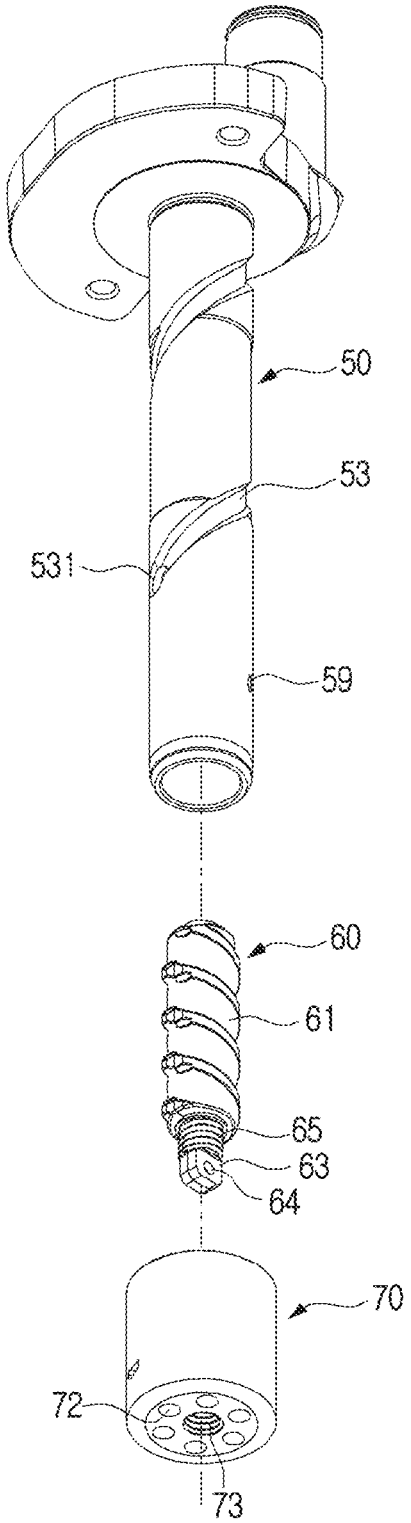
FIG. 11 is an exploded perspective view illustrating the drive shaft assembly of FIG. 10 according to an embodiment of the disclosure.
Figure 12:
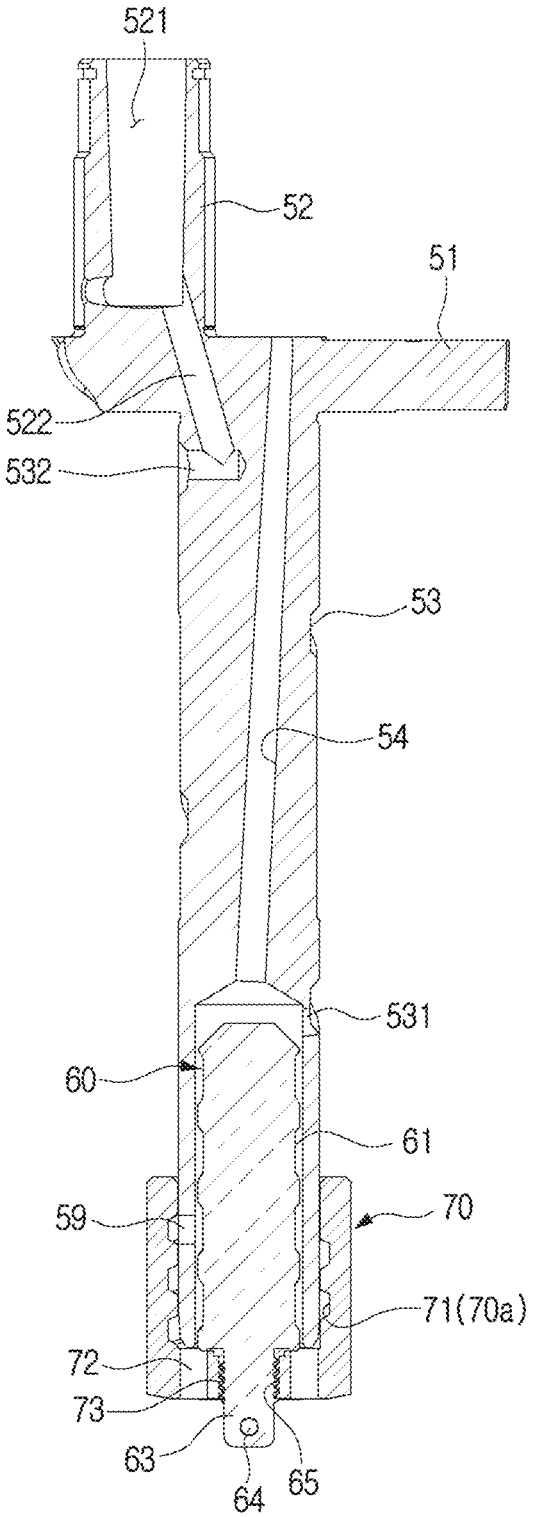
FIG. 12 is a cross-sectional view illustrating the drive shaft assembly of FIG. 10 according to an embodiment of the disclosure.
Figure 13:
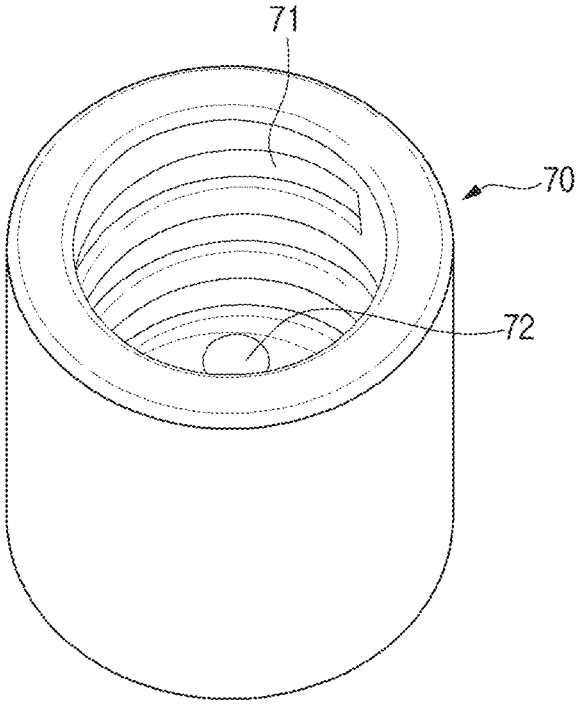
FIG. 13 is a perspective view illustrating a secondary oil pump of the drive shaft assembly of FIG. 10 according to an embodiment of the disclosure.

FIG. 10 is a perspective view illustrating a drive shaft assembly of a reciprocating compressor 1 according to an embodiment of the disclosure. FIG. 11 is an exploded perspective view illustrating the drive shaft assembly of FIG. 10 according to an embodiment of the disclosure. FIG. 12 is a cross-sectional view illustrating the drive shaft assembly of FIG. 10 according to an embodiment of the disclosure. FIG. 13 is a perspective view illustrating a secondary oil pump 70 of the drive shaft assembly of FIG. 10 according to an embodiment of the disclosure.

Referring to FIGS. 10, 11, 12, and 13, the drive shaft assembly may include a drive shaft 50, a primary oil pump 60, and a secondary oil pump 70.

The drive shaft 50 is formed to rotate integrally with the rotor 22 of the motor 20 to operate the compression part 40.

The primary oil pump 60 and the secondary oil pump 70 may be disposed at the lower portion of the drive shaft 50. The lower portion of the drive shaft 50 where the primary oil pump 60 and the secondary oil pump 70 are disposed is integrally with coupled with the rotor 22. In detail, the portion of the drive shaft 50 above the secondary oil pump 70 disposed at the lower portion of the drive shaft 50 is integrally coupled with the rotor 22.

The drive shaft 50 may include a cavity 55, a first oil supply passage 53 and a second oil supply passage 54. The cavity 55, the first oil supply passage 53, and the second oil supply passage 54 of the drive shaft 50 are the same as those of the drive shaft 50 according to the above-described embodiment. Therefore, detailed descriptions thereof are omitted.

The primary oil pump 60 may be disposed at the lower portion of the drive shaft 50. In detail, the primary oil pump 60 is disposed so that the upper portion of the primary oil pump 60 is inserted into the cavity 55 of the drive shaft 50 and the lower portion of the primary oil pump 60 is submerged in oil contained in the oil reservoir 16. Because the primary oil pump 60 is the same as the above-described embodiment, a detailed description thereof is omitted.

The secondary oil pump 70 is disposed at the lower portion of the drive shaft 50. The secondary oil pump 70 may be disposed outside the primary oil pump 60. That is, the secondary oil pump 70 may be disposed to surround the primary oil pump 60. The secondary oil pump 70 may be disposed concentrically with the primary oil pump 60. A secondary oil passage 70*a* is formed between the outer circumferential surface of the lower portion of the drive shaft 50 and the secondary oil pump 70.

The secondary oil passage 70*a* may be formed as a helical groove 71. The diameter of the helical groove 71 forming the secondary oil passage 70*a* is larger than the diameter of the helical groove forming the primary oil passage 61 of the primary oil pump 60. The secondary oil passage 70*a* may be formed around the primary oil passage 61.

The secondary oil passage 70*a* may be formed as the helical groove 71 formed on the inner circumferential surface 703 of the secondary oil pump 70. The helical direction of the helical groove 71, which is the secondary oil passage 70*a* formed on the inner circumferential surface 703 of the secondary oil pump 70, may be formed in the opposite direction to the helical direction of the first oil supply passage 53 formed on the outer circumferential surface of the upper portion of the drive shaft 50. Accordingly, when the drive shaft 50 rotates, the oil in the oil reservoir 16 moves upward along the helical groove 71 formed on the inner circumferential surface 703 of the secondary oil pump 70, that is, the secondary oil passage 70*a*, by the viscous friction force with the outer circumferential surface of the rotating drive shaft 50.

The lower end portion of the drive shaft 50 is inserted into the secondary oil pump 70, and the secondary oil pump 70 is formed to be coupled to the primary oil pump 60. Because the primary oil pump 60 is fixed to the case 10, when the secondary oil pump 70 is coupled to the primary oil pump 60, the secondary oil pump 70 is fixed to the case 10. Therefore, when the drive shaft 50 rotates, the secondary oil pump 70 does not rotate.

The drive shaft 50 may include a communication hole 59. The communication hole 59 is formed to communicate the cavity 55 with the outer circumferential surface of the lower portion of the drive shaft 50. In other words, the communication hole 59 may be formed in the lower portion of the drive shaft 50 to communicate the primary oil passage 61 and the secondary oil passage 70*a*. The communication hole 59 may be formed on the outer circumferential surface of the drive shaft 50 below the first oil inlet 531 of the first oil supply passage 53.

The upper end of the secondary oil passage 70*a* may be formed below the upper end of the secondary oil pump 70. When the upper end of the secondary oil passage 70*a* is located above the upper end of the secondary oil pump 70, oil supplied by the secondary oil pump 70 may leak out.

The upper end of the secondary oil passage 70*a* may be formed to correspond to the communication hole 59. That is, the communication hole 59 is formed at a position corresponding to the upper end of the secondary oil passage 70*a* so that oil supplied through the secondary oil passage 70*a* may flow into the cavity 55 of the drive shaft 50 through the communication hole 59. Accordingly, the communication hole 59 is located below the upper end of the secondary oil pump 70.

The secondary oil pump 70 may be formed in the shape of a cylindrical shape with a bottom. That is, the secondary oil pump 70 may be formed in a hollow cylindrical shape with an open top and a closed bottom.

The inner diameter of the secondary oil pump 70 is larger than the outer diameter of the drive shaft 50. For example, the gap between the inner circumferential surface of the secondary oil pump 70 and the outer circumferential surface of the drive shaft 50 may be 0.1 mm to 0.15 mm.

The helical groove 71 may be formed on the inner circumferential surface of the secondary oil pump 70. This helical groove 71 forms the secondary oil passage 70*a*.

A coupling hole 73 may be formed in the bottom 701 of the secondary oil pump 70. The coupling hole 73 may be formed at the center of the bottom 701 of the secondary oil pump 70.

The coupling hole 73 is formed to be coupled to the coupling protrusion 63 of the primary oil pump 60. The coupling hole 73 may be formed with a female screw. That is, a female screw corresponding to the male screw 65 of the coupling protrusion 63 of the primary oil pump 60 may be formed on the inner circumferential surface of the coupling hole 73. Accordingly, the coupling protrusion 63 of the primary oil pump 60 may be screwed to the coupling hole 73 of the secondary oil pump 70.

The secondary oil pump 70 may include a plurality of oil inlets 72. The plurality of oil inlets 72 may be formed around the coupling hole 73 at the bottom 701 of the secondary oil pump 70. The plurality of oil inlets 72 may be formed at regular intervals around the coupling hole 73.

When the secondary oil pump 70 is submerged in the oil reservoir 16, the oil in the oil reservoir 16 may flow into the internal space of the secondary oil pump 70 through the plurality of oil inlets 72.

In the above, the case where the primary oil pump 60 and the secondary oil pump 70 are coupled by screw coupling has been described. However, the connection of the primary oil pump 60 and the secondary oil pump 70 is not limited to this. For example, the primary oil pump 60 and the secondary oil pump 70 may be coupled by various coupling methods such as press-fit coupling, one-touch coupling, insertion coupling, etc.

Hereinafter, various coupling methods of the primary oil pump 60 and the secondary oil pump 70 will be described with reference to FIGS. 14, 15, 16, 17, and 18.

Figure 14:
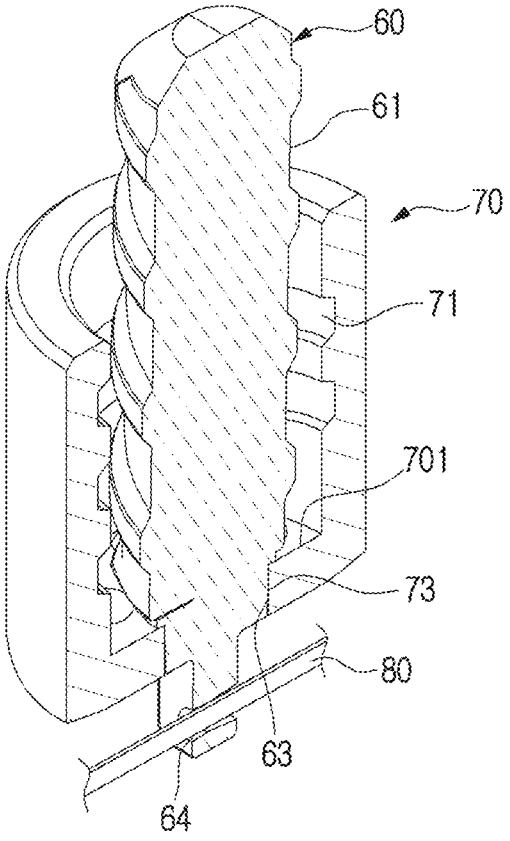
FIG. 14 is a cross-sectional perspective view illustrating a state in which a primary oil pump and a secondary oil pump of a reciprocating compressor are coupled to each other according to an embodiment of the disclosure.

FIG. 14 is a cross-sectional perspective view illustrating a state in which a primary oil pump 60 and a secondary oil pump 70 of a reciprocating compressor 1 are coupled to each other according to an embodiment of the disclosure.

Referring to FIG. 14, the primary oil pump 60 and the secondary oil pump 70 are coupled by press-fitting. The coupling protrusion 63 of the primary oil pump 60 is formed in a cylindrical shape, and the coupling hole 73 of the secondary oil pump 70 is formed as a circular hole. In this case, the diameter of the coupling protrusion 63 and the inner diameter of the coupling hole 73 are formed to provide an interference fit. Then, the coupling protrusion 63 of the primary oil pump 60 is pressed into the coupling hole 73 of the secondary oil pump 70, thereby coupling the primary oil pump 60 and the secondary oil pump 70.

In this case, the coupling protrusion 63 of the primary oil pump 60 is fixed by being press-fitted into the coupling hole 73 of the secondary oil pump 70, so that the secondary oil pump 70 does not rotate with respect to the primary oil pump 60.

In addition, a through hole 64 is formed in the lower portion of the coupling protrusion 63 of the primary oil pump 60. A metal wire 80 fixed to the lower case 12 is inserted into the through hole 64. Therefore, when the drive shaft 50 rotates, the primary oil pump 60 and the secondary oil pump 70 do not rotate.

Figure 15:
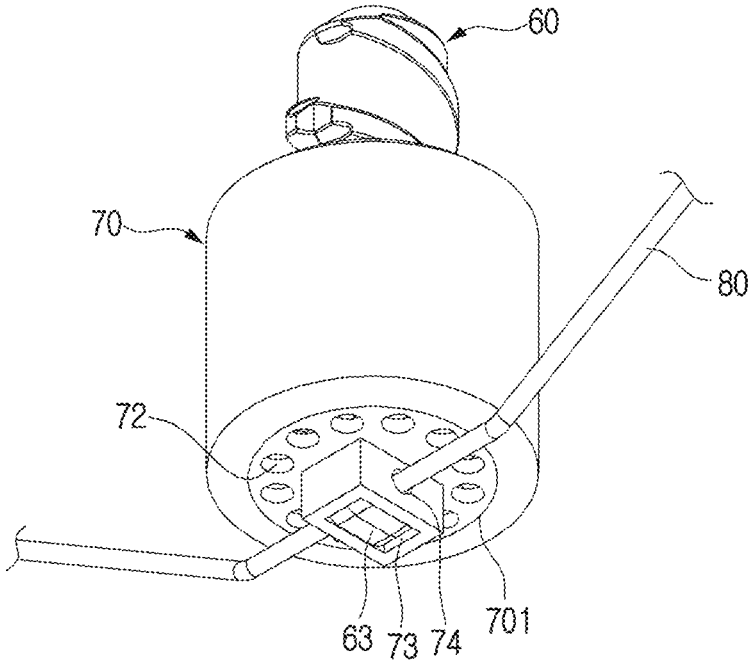
FIG. 15 is a perspective view illustrating a state in which a primary oil pump and a secondary oil pump of a reciprocating compressor are coupled to each other according to an embodiment of the disclosure.

FIG. 15 is a perspective view illustrating a state in which a primary oil pump 60 and a secondary oil pump 70 of a reciprocating compressor 1 are coupled to each other according to an embodiment of the disclosure.

Referring to FIG. 15, the primary oil pump 60 and the secondary oil pump 70 are coupled by insertion coupling. The coupling protrusion 63 of the primary oil pump 60 is formed in the shape of a square pillar, and the coupling hole 73 of the secondary oil pump 70 is formed as a square hole. The coupling hole 73 may be formed in the shape of a square pipe extending downward from the bottom 701 of the secondary oil pump 70.

In this case, the square pillar-shaped coupling protrusion 63 is formed to correspond to the square coupling hole 73. That is, the coupling protrusion 63 is formed to be easily inserted into the coupling hole 73 and not rotate with respect to the coupling hole 73. Then, the coupling protrusion 63 of the primary oil pump 60 is inserted into the coupling hole 73 of the secondary oil pump 70 to couple the primary oil pump 60 and the secondary oil pump 70.

At this time, because the square pillar-shaped coupling protrusion 63 of the primary oil pump 60 is inserted into the square coupling hole 73 of the secondary oil pump 70, the secondary oil pump 70 does not rotate with respect to the primary oil pump 60.

In addition, a through hole 64 is formed in the lower portion of the coupling protrusion 63 of the primary oil pump 60. A hole 74 corresponding to the through hole 64 is formed on the side surface of the square pipe forming the coupling hole 73 of the secondary oil pump 70. A metal wire 80 fixed to the lower case 12 is inserted into the hole 74 of the secondary oil pump 70 and the through hole 64 of the primary oil pump 60. Therefore, when the drive shaft 50 rotates, the primary oil pump 60 and the secondary oil pump 70 do not rotate.

Figure 16:
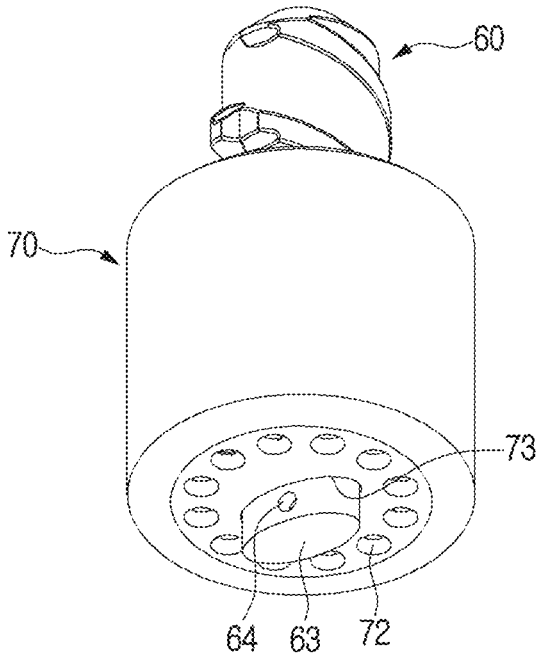
FIG. 16 is a perspective view illustrating a state in which a primary oil pump and a secondary oil pump of a reciprocating compressor are coupled to each other according to an embodiment of the disclosure.

FIG. 16 is a view illustrating a state in which a primary oil pump 60 and a secondary oil pump 70 of a reciprocating compressor 1 are coupled to each other according to an embodiment of the disclosure.

Referring to FIG. 16, the primary oil pump 60 and the secondary oil pump 70 are coupled by insertion coupling. The coupling protrusion 63 of the primary oil pump 60 is formed in a pillar shape with an elliptical cross-section, and the coupling hole 73 of the secondary oil pump 70 is formed as an elliptical hole.

In this case, the coupling protrusion 63 having the elliptical cross-section is formed to correspond to the oval-shaped coupling hole 73. That is, the coupling protrusion 63 is formed to be easily inserted into the coupling hole 73 and not rotate with respect to the coupling hole 73. Then, the coupling protrusion 63 of the primary oil pump 60 is inserted into the coupling hole 73 of the secondary oil pump 70 to couple the primary oil pump 60 and the secondary oil pump 70.

At this time, because the coupling protrusion 63 having the oval pillar shape of the primary oil pump 60 is inserted into the oval-shaped coupling hole 73 of the secondary oil pump 70, the secondary oil pump 70 does not rotate with respect to the primary oil pump 60.

The primary oil pump 60 is fixed to a metal wire 80 fixed to the lower case 12. Therefore, when the drive shaft 50 rotates, the primary oil pump 60 and the secondary oil pump 70 do not rotate.

In the above, the cases where the coupling hole 73 of the secondary oil pump 70, into which the coupling protrusion 63 of the primary oil pump 60 is inserted, has a square and oval cross-section have been described. However, the shape of the coupling hole 73 is not limited thereto. The coupling hole 73 may be formed in a polygon other than a square. For example, the coupling hole 73 may be formed in a triangle, pentagon, etc. In this case, the coupling protrusion 63 of the primary oil pump 60 may be formed in a pillar having a cross-section corresponding to the coupling hole 73 of the secondary oil pump 70.

Figure 17:
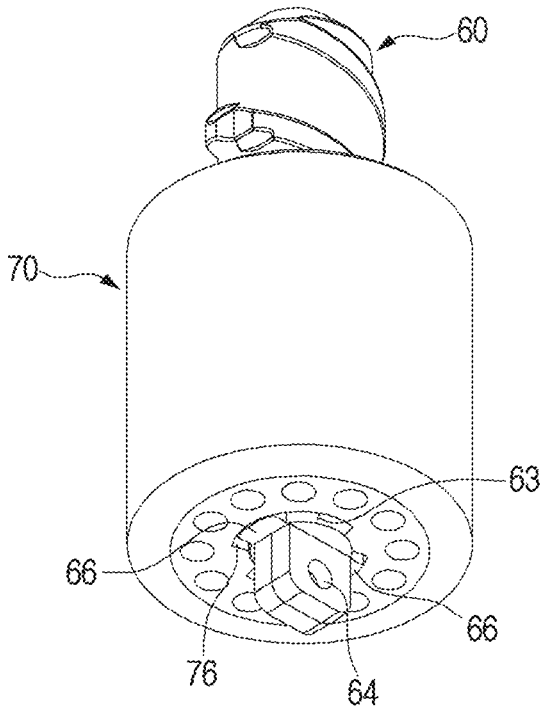
FIG. 17 is a perspective view illustrating a state in which a primary oil pump and a secondary oil pump of a reciprocating compressor are coupled to each other according to an embodiment of the disclosure.
Figure 18:
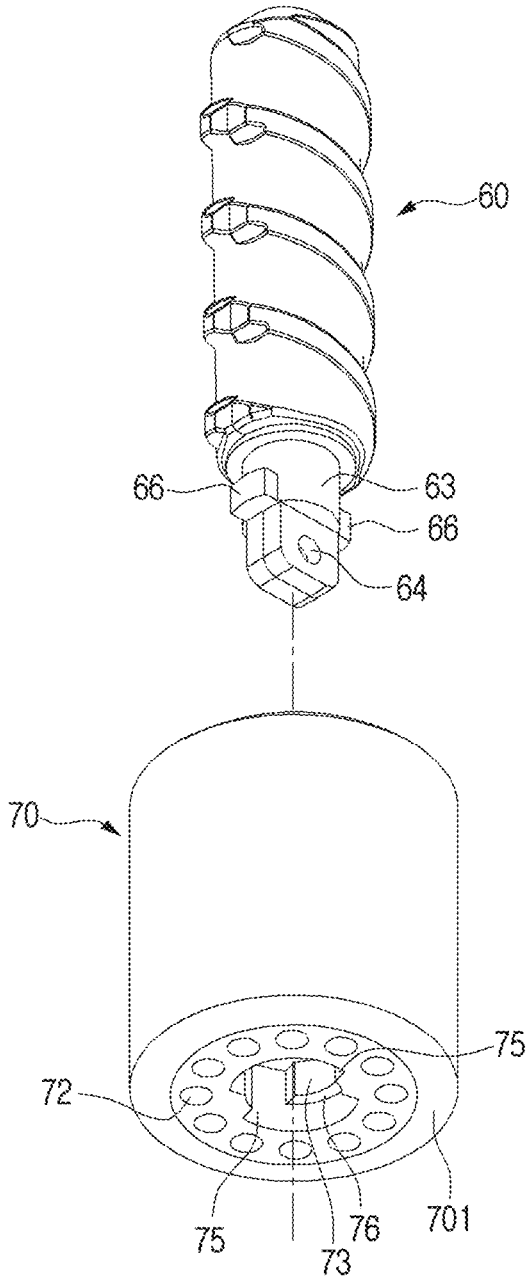
FIG. 18 is a perspective view illustrating a state in which the primary oil pump and the secondary oil pump of FIG. 17 are separated according to an embodiment of the disclosure.

FIG. 17 is a view illustrating a state in which a primary oil pump 60 and a secondary oil pump 70 of a reciprocating compressor 1 are coupled to each other according to an embodiment of the disclosure. FIG. 18 is a perspective view illustrating a state in which the primary oil pump 60 and the secondary oil pump 70 of FIG. 17 are separated according to an embodiment of the disclosure.

Referring to FIGS. 17 and 18, the primary oil pump 60 and the secondary oil pump 70 are coupled by one-touch coupling.

The coupling protrusion 63 of the primary oil pump 60 may include a pair of locking portions 66. The coupling protrusion 63 is formed in a cylindrical shape. The pair of locking portions 66 are to protrude vertically outward from the outer circumferential surface of the coupling protrusion 63. The pair of locking portions 66 are formed at 180 degree intervals.

The coupling hole 73 of the secondary oil pump 70 may include a pair of insertion grooves 75 and a pair of fixing portions 76. The coupling hole 73 may be formed as a circular hole into which the coupling protrusion 63 is inserted.

The pair of insertion groove 75 may be formed on the inner circumferential surface of the coupling hole 73. The pair of insertion groove 75 are formed at 180 degree intervals on the inner circumferential surface of the coupling hole 73. The pair of insertion grooves 75 are formed so that the pair of locking portions 66 of the coupling protrusion 63 can pass through the pair of insertion grooves 75.

The pair of fixing portions 76 may be formed to have a certain length from the pair of insertion grooves 75 along the inner circumferential surface of the coupling hole 73. The pair of fixing portions 76 are formed so that the pair of locking portions 66 of the coupling protrusion 63 are caught by the pair of the fixing portions 76.

Therefore, by aligning the pair of locking portions 66 of the coupling protrusion 63 with the pair of insertion grooves 75 of the coupling hole 73, the coupling protrusion 63 may be inserted into the coupling hole 73. In this state, when the coupling protrusion 63 is rotated by about 90 degrees, the pair of locking portions 66 of the coupling protrusion 63 are caught by the pair of fixing portions 76 of the coupling hole 73. Then, the primary oil pump 60 is coupled to the secondary oil pump 70, so that the primary oil pump 60 is not separated from the secondary oil pump 70. Therefore, when the drive shaft 50 rotates, the primary oil pump 60 and the secondary oil pump 70 do not rotate.

Figure 19:
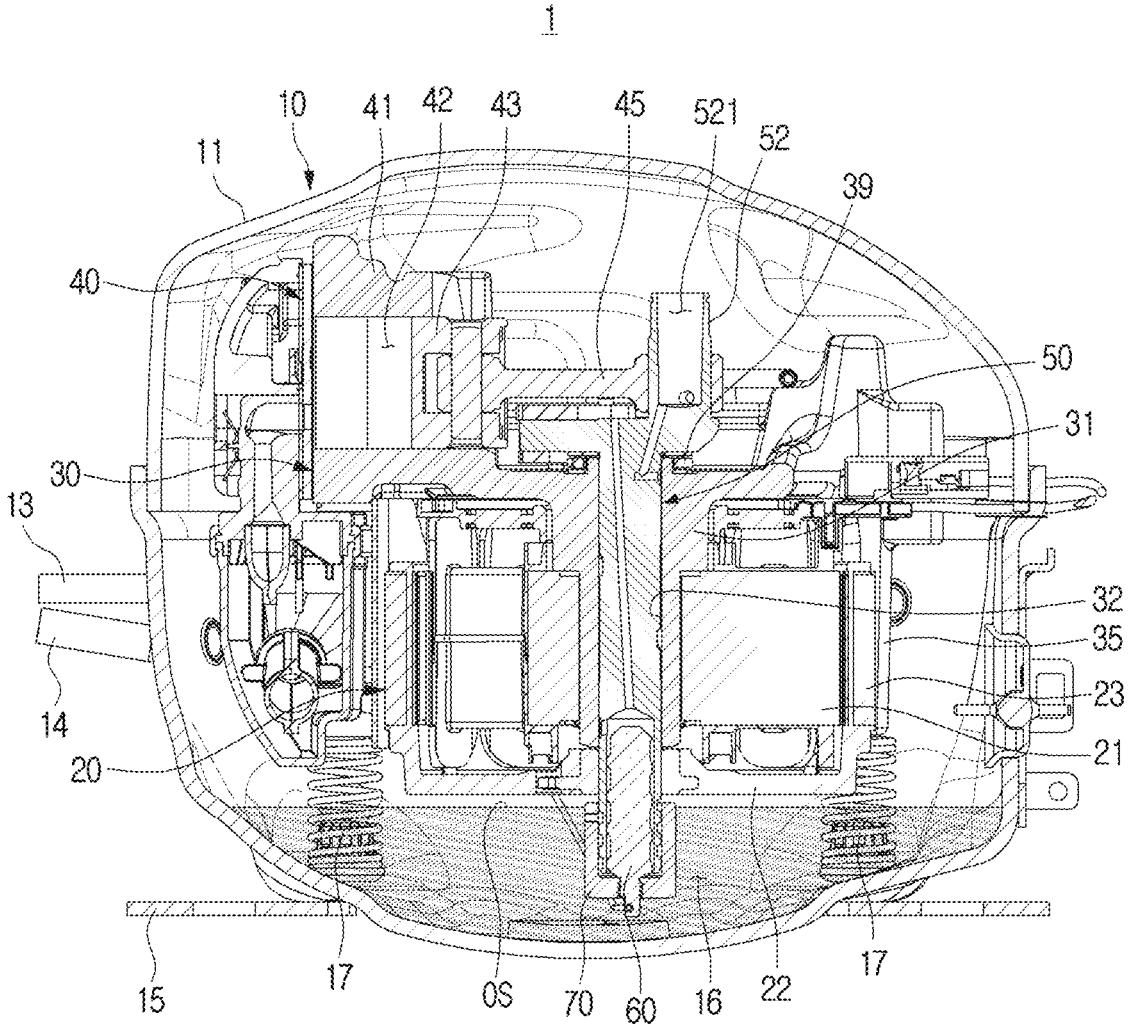
FIG. 19 is a cross-sectional view illustrating a reciprocating compressor according to an embodiment of the disclosure.
Figure 20:
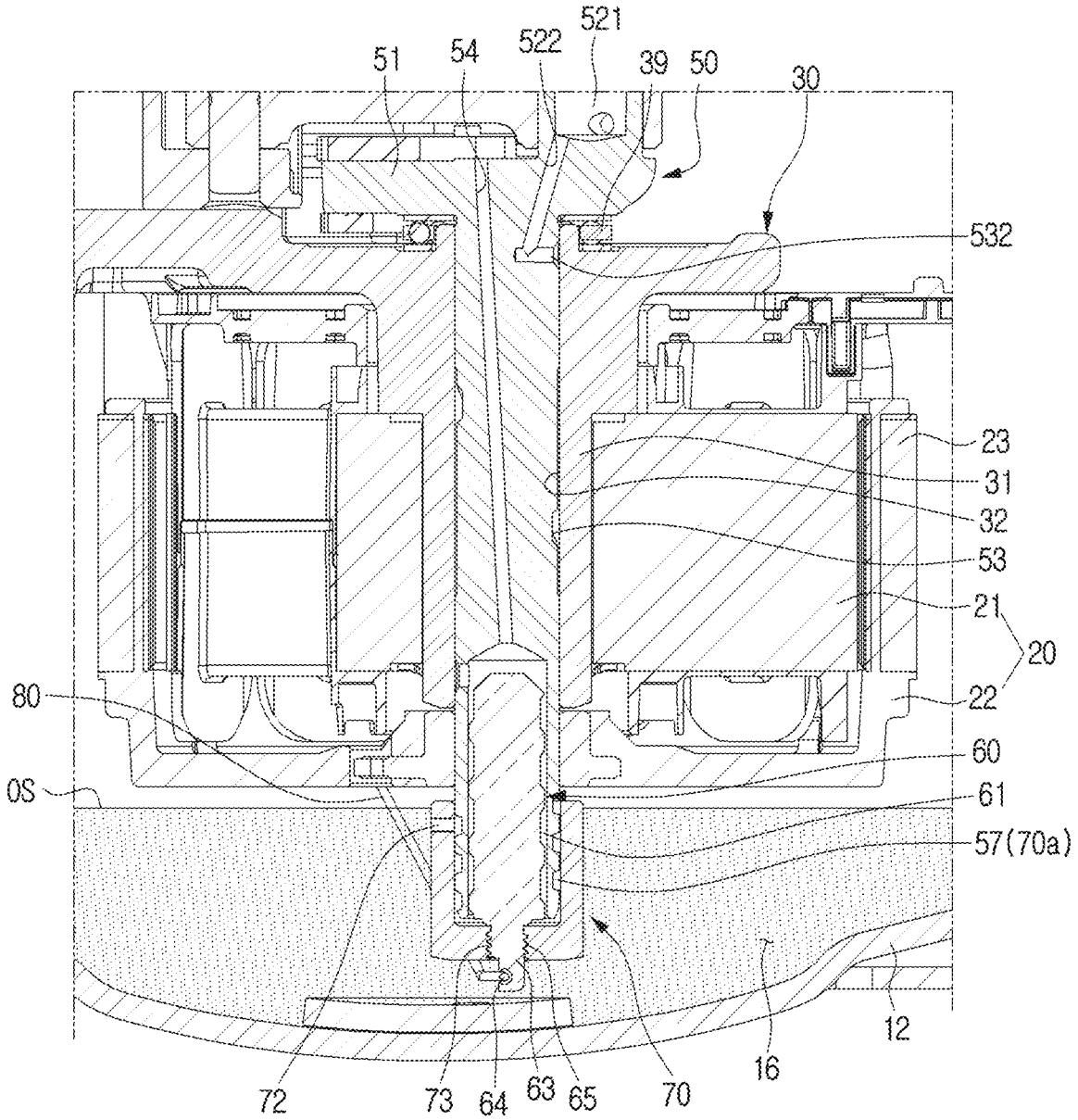
FIG. 20 is an enlarged partial cross-sectional view illustrating main components of the reciprocating compressor of FIG. 19 according to an embodiment of the disclosure.

FIG. 19 is a cross-sectional view illustrating a reciprocating compressor 1 according to an embodiment of the disclosure. FIG. 20 is an enlarged partial cross-sectional view illustrating main components of the reciprocating compressor 1 of FIG. 19 according to an embodiment of the disclosure.

Referring to FIGS. 19 and 20, a reciprocating compressor 1 according to an embodiment of the disclosure may include a case 10 and a motor 20.

The case 10 forms the exterior of the reciprocating compressor 1 and may be formed as a hermetic container. The motor 20 may be disposed inside the case 10. The case 10 may include a lower case 12 and an upper case 11 covering the upper side of the lower case 12.

The case 10 is formed by coupling the upper case 11 and the lower case 12, and the inside of the case 10 except the refrigerant inlet pipe 13 and the refrigerant discharge pipe 14 may be hermetic. In other words, the refrigerant may flow into the inside of the case 10 only through the refrigerant inlet pipe 13, and may be discharged to the outside of the case 10 only through the refrigerant discharge pipe 14.

An oil reservoir 16 containing oil may be provided in the lower portion of the lower case 12.

The motor 20 is disposed inside the case 10 and includes a stator 21 and a rotor 22. The stator 21 is disposed to be fixed to the case 10. The rotor 22 may be disposed to rotate with respect to the stator 21.

In this embodiment, the rotor 22 is disposed outside the stator 21. That is, the stator 21 is disposed inside the rotor 22. Accordingly, the rotor 22 may rotate around the stator 21 outside of the stator 21. As another embodiment, the rotor 22 may be rotatably disposed inside the stator 21.

The reciprocating compressor 1 may further include a bearing block 30 and a compression part 40.

The bearing block 30 is disposed inside the case 10. The motor 20 may be disposed at the lower side of the bearing block 30, and the compression part 40 may be disposed at the upper side of the bearing block 30.

The bearing block 30 may be disposed at the bottom of the lower case 12. The bearing block 30 may be supported by a pair of elastic supporters 17 disposed at the bottom of the lower case 12.

The bearing block 30 may include a fixed shaft 31. The fixed shaft 31 may be formed to extend vertically downward from the lower surface of the bearing block 30. The fixed shaft 31 may be formed in a cylindrical shape.

A shaft hole 32 may be formed inside the fixed shaft 31. The shaft hole 32 may be formed to have a circular cross-section. The shaft hole 32 is formed to penetrate the fixed shaft 31 and the bearing block 30 vertically.

The stator 21 is disposed on the outer circumferential surface of the fixed shaft 31, and a drive shaft 50 is inserted into the shaft hole 32 of the fixed shaft 31.

The inner circumferential surface of the shaft hole 32 is surface processed to function as a bearing that supports the rotation of the drive shaft 50. Therefore, the drive shaft 50 may rotate relative to the fixed shaft 31 while inserted into the shaft hole 32.

The bearing block 30 may include a pair of legs 35 extending downward from the lower surface thereof. The pair of legs 35 may be formed symmetrically about the fixed shaft 31. In other words, the fixed shaft 31 may be formed between the pair of legs 35.

The lower surfaces of the pair of legs 35 may be supported by the pair of elastic supporters 17. The upper end of the elastic supporter 17 may be fixed to the lower surface of the leg 35, and the lower end of the elastic supporter 17 may be fixed to the bottom of the lower case 12. Each of the pair of elastic supporters 17 may be formed as a coil spring.

The motor 20 may be disposed at the lower side of the bearing block 30. The motor 20 may be configured to generate a rotational force to operate the compression part 40. The motor 20 may include the stator 21 and the rotor 22.

The stator 21 may be fixed to the lower surface of the bearing block 30. The stator 21 may include a stator core and a coil. The stator core may be formed by stacking pressed steel plates.

The rotor 22 is disposed outside the stator 21. In other words, the stator 21 is disposed inside the rotor 22. Accordingly, the rotor 22 may rotate around the stator 21 outside of the stator 21.

The rotor 22 may be formed in a cylindrical container shape. In other words, the rotor 22 may be formed in a hollow cylindrical shape with the lower end closed and the upper end open. The stator 21 may be accommodated inside the rotor 22. A plurality of permanent magnets 23 are disposed on the outer circumferential surface of the rotor 22. The plurality of permanent magnets 23 may be arranged at regular intervals in the circumferential direction of the rotor 22.

The compression part 40 is formed to compress and discharge the refrigerant introduced through the refrigerant inlet pipe 13. The compression part 40 may be provided on the upper surface of the bearing block 30.

The compression part 40 may include a cylinder block 41, a piston 43, and a connecting rod 45.

The cylinder block 41 is formed on the upper surface of the bearing block 30. A compression chamber 42 having a circular cross-section is formed inside the cylinder block 41. An inlet valve and a discharge valve are provided at the outer end of the cylinder block 41.

The piston 43 is inserted into the compression chamber 42 of the cylinder block 41. The piston 43 is formed to linearly reciprocate a certain distance along the inner surface of the compression chamber 42 of the cylinder block 41.

The piston 43 is connected to one end of the connecting rod 45. The other end of the connecting rod 45 is connected to the crank shaft 52 of the drive shaft 50. Accordingly, when the drive shaft 50 rotates, the piston 43 may linearly reciprocate in the compression chamber 42 of the cylinder block 41 by the crank shaft 52 and the connecting rod 45. In other words, the rotational motion of the drive shaft 50 may be converted into the linear reciprocating motion of the piston 43 by the connecting rod 45 and the crank shaft 52 of the drive shaft 50.

When the piston 43 linearly reciprocates in the compression chamber 42 of the cylinder block 41, the refrigerant may flow into the compression chamber 42 through the inlet valve, may be compressed, and then may be discharged to the outside of the compression chamber 42 through the discharge valve.

Referring to FIGS. 19 and 20, the drive shaft 50 may be fixed to the center of the rotor 22. Accordingly, when the rotor 22 rotates, the drive shaft 50 may rotate integrally with the rotor 22.

The drive shaft 50 is inserted into the shaft hole 32 of the fixed shaft 31 of the bearing block 30. The drive shaft 50 is rotatably supported by the shaft hole 32. Accordingly, when the rotor 22 rotates, the drive shaft 50 may rotate inside the shaft hole 32 of the fixed shaft 31.

A head portion 51 is provided at the upper end of the drive shaft 50. The head portion 51 is formed to have a diameter larger than the diameter of the drive shaft 50. The head portion 51 is formed to rotate integrally with the drive shaft 50.

A bearing 39 is disposed between the head portion 51 and the upper surface of the bearing block 30. Accordingly, when the drive shaft 50 rotates, the head portion 51 may rotate with respect to the upper surface of the bearing block 30.

The crank shaft 52 is provided on the upper surface of the head portion 51. The crank shaft 52 is formed perpendicular to the upper surface of the head portion 51. The crank shaft 52 is formed to be eccentric with the drive shaft 50. In other words, the center line of the drive shaft 50 is spaced apart from the center line of the crank shaft 52 by a predetermined distance. The connecting rod 45 may be connected to the crank shaft 52.

An oil groove 521 may be formed at the top of the crank shaft 52. The oil groove 521 may be formed at a predetermined depth on the upper surface of the crank shaft 52.

The lower end of the drive shaft 50 may protrude below the rotor 22 and may be submerged in the oil contained in the oil reservoir 16.

The reciprocating compressor 1 may include a primary oil pump 60 and a secondary oil pump 70. The primary oil pump 60 and the secondary oil pump 70 are disposed at the lower portion of the drive shaft 50 and are configured to pump the oil contained in the oil reservoir 16 of the case 10 to the upper side of the drive shaft 50. The primary oil pump 60 and the secondary oil pump 70 are disposed at the lower portion of the drive shaft 50 protruding below the rotor 22.

The drive shaft 50, the primary oil pump 60, and the secondary oil pump 70 may form a drive shaft assembly.

Hereinafter, the drive shaft assembly according to an embodiment of the disclosure will be described in detail with reference to FIGS. 21, 22, 23, and 24.

Figure 21:
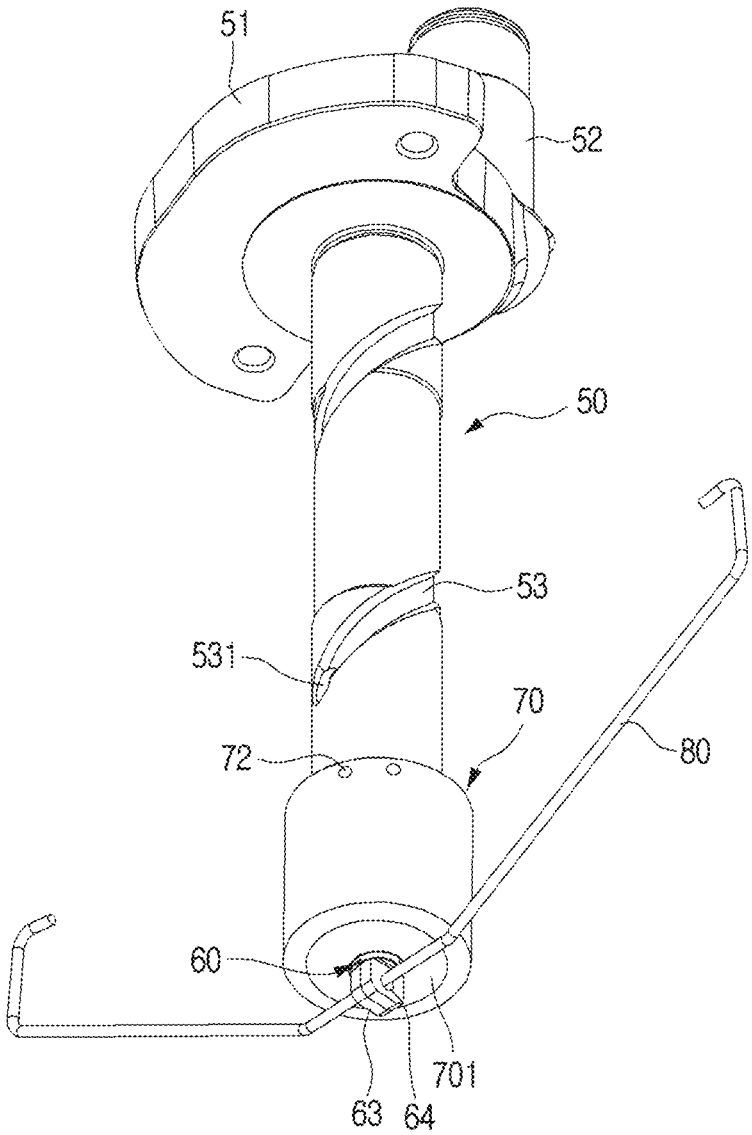
FIG. 21 is a perspective view illustrating a drive shaft assembly of a reciprocating compressor according to an embodiment of the disclosure.
Figure 22:
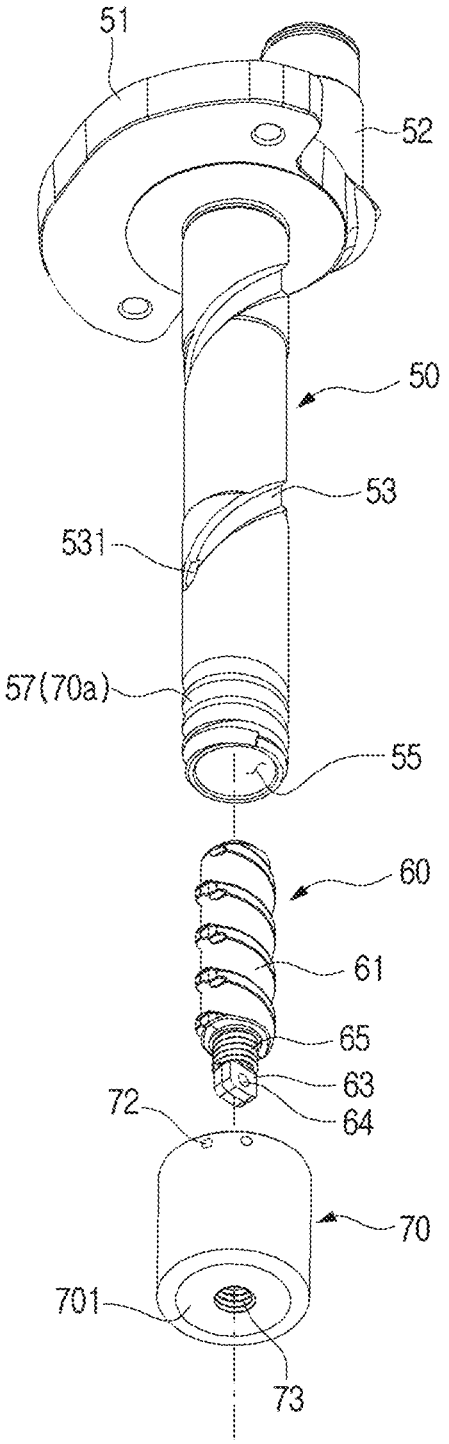
FIG. 22 is an exploded perspective view illustrating the drive shaft assembly of FIG. 21 according to an embodiment of the disclosure.
Figure 23:
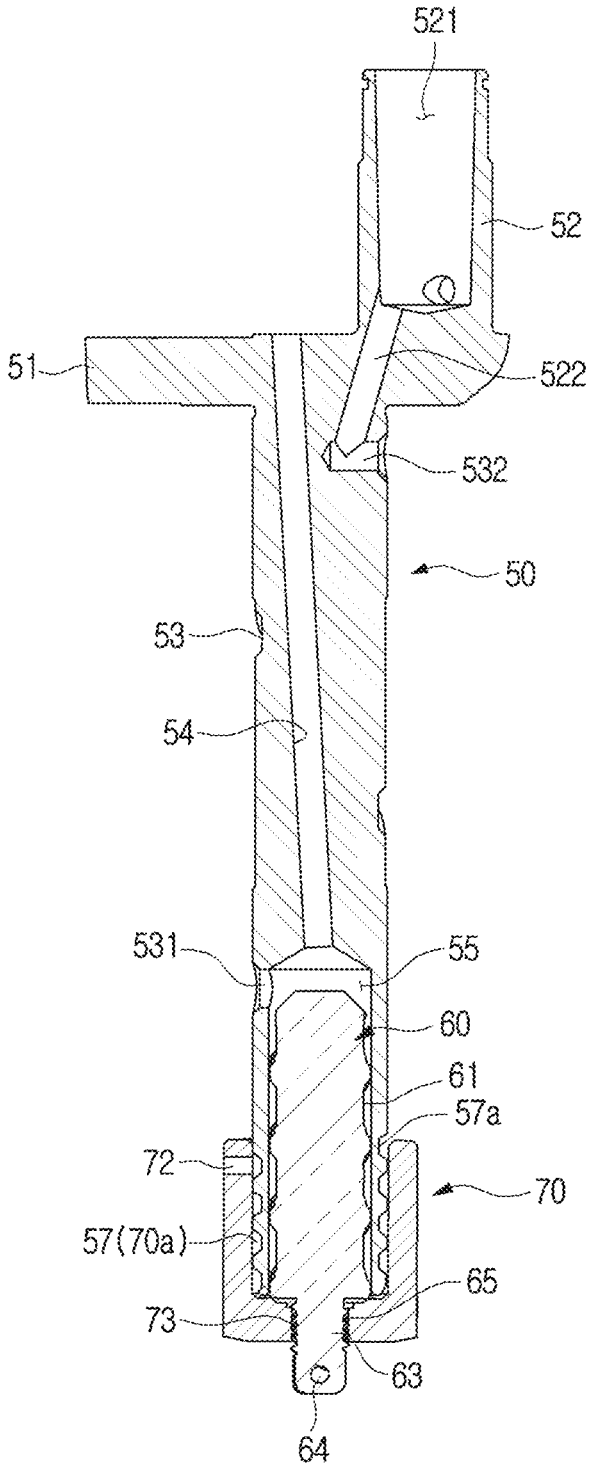
FIG. 23 is a cross-sectional view illustrating the drive shaft assembly of FIG. 21 according to an embodiment of the disclosure.
Figure 24:
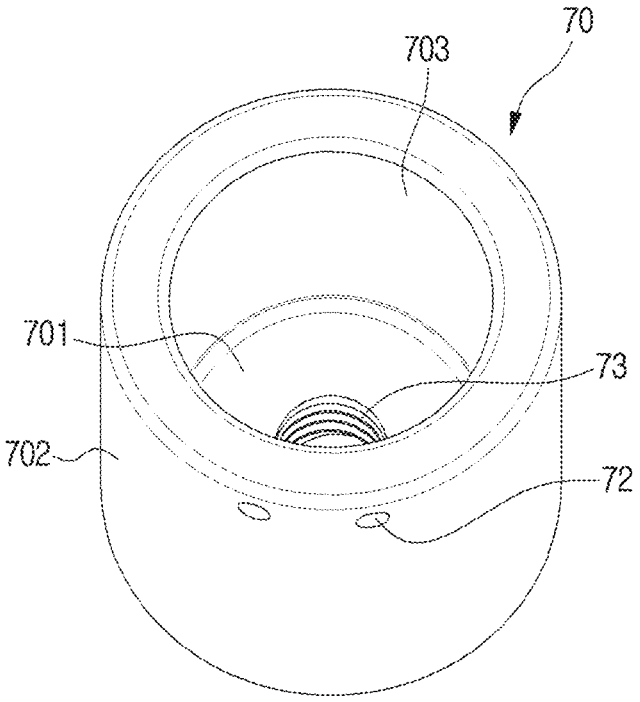
FIG. 24 is a perspective view illustrating a secondary oil pump of the drive shaft assembly of FIG. 21 according to an embodiment of the disclosure.

FIG. 21 is a perspective view illustrating a drive shaft assembly of a reciprocating compressor 1 according to an embodiment of the disclosure. FIG. 22 is an exploded perspective view illustrating the drive shaft assembly of FIG. 21 according to an embodiment of the disclosure. FIG. 23 is a cross-sectional view illustrating the drive shaft assembly of FIG. 21 according to an embodiment of the disclosure. FIG. 24 is a perspective view illustrating a secondary oil pump 70 of the drive shaft assembly of FIG. 21 according to an embodiment of the disclosure.

Referring to FIGS. 21, 22, 23, and 24, the drive shaft assembly may include the drive shaft 50, the primary oil pump 60, and the secondary oil pump 70.

The drive shaft 50 is formed to rotate integrally with the rotor 22 of the motor 20 to operate the compression part 40.

The primary oil pump 60 and the secondary oil pump 70 may be disposed at the lower portion of the drive shaft 50. The lower portion of the drive shaft 50 where the primary oil pump 60 and the secondary oil pump 70 are disposed is integrally with coupled with the rotor 22. In detail, the portion of the drive shaft 50 above the secondary oil pump 70 disposed at the lower portion of the drive shaft 50 is integrally coupled with the rotor 22. The primary oil pump 60 and the secondary oil pump 70 form a dual oil pump that pumps the oil contained in the oil reservoir 16.

The drive shaft 50 may include a cavity 55, a first oil supply passage 53, and a second oil supply passage 54.

The cavity 55 may be formed at the bottom of the drive shaft 50. The cavity 55 may be formed at a predetermined depth on the lower surface of the drive shaft 50. The cavity 55 may be formed as a hole with a circular cross-section. The primary oil pump 60 may be inserted into the cavity 55.

The portion of the drive shaft 50 where the cavity 55 is formed is the lower portion of the drive shaft 50, and the portion of the drive shaft 50 above the cavity 55, that is, the portion of the drive shaft 50 between the cavity 55 and the head portion 51 is the upper portion of the drive shaft 50.

The first oil supply passage 53 may be formed as a helical groove on the outer circumferential surface of the drive shaft 50. The first oil supply passage 53 may be formed as a groove having a certain width and depth on the outer circumferential surface of the upper portion of the drive shaft 50.

A first oil inlet 531 may be formed at the lower end of the first oil supply passage 53. The first oil inlet 531 may penetrate the outer circumferential surface of the drive shaft 50 and communicate with the cavity 55. The first oil inlet 531 may be formed adjacent to the top of the cavity 55. Accordingly, oil in the cavity 55 may flow into the first oil supply passage 53 through the first oil inlet 531.

A first oil outlet 532 may be formed at the upper end of the first oil supply passage 53. The first oil outlet 532 is connected to the oil passage 522 formed at the bottom of the oil groove 521 of the crank shaft 52. Accordingly, the first oil supply passage 53 is connected to the oil groove 521 of the crank shaft 52 through the first oil outlet 532 and the oil passage 522.

The oil passage 522 is formed to be inclined with respect to the longitudinal direction of the crank shaft 52. Because the oil passage 522 is inclined, when the drive shaft 50 rotates, oil may move to the oil groove 521 of the crank shaft 52 by centrifugal force.

The second oil supply passage 54 is formed to penetrate the drive shaft 50 vertically. In detail, the second oil supply passage 54 is formed to communicate with the upper end of the cavity 55 and the upper surface of the head portion 51. The second oil supply passage 54 is formed to be inclined with respect to the longitudinal direction of the drive shaft 50. Because the second oil supply passage 54 is formed to be inclined, when the drive shaft 50 rotates, the oil in the cavity 55 may move to the upper side of the head portion 51 due to centrifugal force.

The primary oil pump 60 may be disposed at the lower portion of the drive shaft 50. In detail, the primary oil pump 60 is disposed to be inserted into the cavity 55 of the drive shaft 50. The portion of the drive shaft 50 protruding below the rotor 22 and the lower portion of the primary oil pump 60 are disposed to be submerged in the oil in the oil reservoir 16.

The primary oil pump 60 may be formed in a cylindrical shape. The diameter of the primary oil pump 60 is formed to be smaller than the diameter of the cavity 55 of the drive shaft 50. Accordingly, a certain gap is provided between the primary oil pump 60 and the inner circumferential surface of the cavity 55 of the drive shaft 50. For example, the gap of 0.1 mm to 0.15 mm may be formed between the outer circumferential surface of the primary oil pump 60 and the inner circumferential surface of the cavity 55 of the drive shaft 50.

A helical groove 71 may be formed on the outer circumferential surface of the primary oil pump 60. This helical groove 71 forms the primary oil passage 61. Accordingly, the helical-shaped primary oil passage 61 is provided between the primary oil pump 60 and the cavity 55 of the drive shaft 50. Therefore, when the drive shaft 50 rotates, the oil in the oil reservoir 16 moves upward along the primary oil passage 61 by the viscous friction force with the inner circumferential surface of the cavity 55 of the rotating drive shaft 50.

The helical direction of the helical groove forming the primary oil passage 61 may be formed in a direction opposite to the helical direction of the first oil supply passage 53 of the drive shaft 50.

The primary oil pump 60 may include a coupling protrusion 63. The coupling protrusion 63 may be formed to protrude from the lower surface of the primary oil pump 60. The coupling protrusion 63 may be formed in a cylindrical shape. A screw thread 65 may be formed on the outer circumferential surface of the coupling protrusion 63. In other words, the coupling protrusion 63 may be formed as a male screw.

A through hole 64 through which a metal wire 80 penetrates may be formed in the lower portion of the coupling protrusion 63. Both ends of the metal wire 80 inserted into the through hole 64 of the coupling protrusion 63 may be fixed to the lower case 12. Because the metal wire 80 is fixed to the lower case 12, the primary oil pump 60 coupled to the metal wire 80 is fixed to the case 10. Therefore, when the drive shaft 50 rotates, the primary oil pump 60 does not rotate and remains fixed.

The secondary oil pump 70 is disposed at the lower portion of the drive shaft 50. The secondary oil pump 70 may be disposed outside the primary oil pump 60. That is, the secondary oil pump 70 may be disposed to surround the primary oil pump 60. The secondary oil pump 70 may be disposed to surround the primary oil pump 60 and the lower portion of the drive shaft 50.

The secondary oil pump 70 may be disposed concentrically with the primary oil pump 60. A secondary oil passage **70*a* is formed between the outer circumferential surface of the lower portion of the drive shaft 50 and the secondary oil pump 70**.

The secondary oil passage **70*a* may be formed as a helical groove 57. The diameter of the helical groove 57 forming the secondary oil passage 70*a* is larger than the diameter of the helical groove 71 of the primary oil pump 60. The secondary oil passage 70*a* may be formed around the primary oil passage 61**.

The secondary oil passage **70*a* may be formed as the helical groove 57 formed on the outer circumferential surface of the lower portion of the drive shaft 50. The helical groove 57 may be formed to have a certain length from the lower end of the drive shaft 50**.

The helical direction of the helical groove 57 of the secondary oil passage **70*a* formed on the outer circumferential surface of the lower portion of the drive shaft 50 is formed in the opposite direction to the helical direction of the first oil supply passage 53 formed on the outer circumferential surface of the upper portion of the drive shaft 50. For example, when the helical direction of the first oil supply passage 53 is a right-handed helical direction, the helical direction of the secondary oil passage 70***a* is a left-handed helical direction.

Therefore, when the drive shaft 50 rotates, the oil contained in the oil reservoir 16 moves to the lower end of the drive shaft 50, that is, the lower end of the secondary oil passage 70*a* along the helical groove of the lower portion of the rotating drive shaft 50, that is, the secondary oil passage 70*a* by the viscous friction force.

The lower end portion of the drive shaft 50 is inserted into the secondary oil pump 70, and the secondary oil pump 70 is formed to be coupled to the primary oil pump 60. Because the primary oil pump 60 is fixed to the case 10, when the secondary oil pump 70 is coupled to the primary oil pump 60, the secondary oil pump 70 is fixed to the case 10. Therefore, when the drive shaft 50 rotates, the secondary oil pump 70 does not rotate.

The upper end of the secondary oil passage 70*a* may be formed to be located above the upper end of the secondary oil pump 70. In detail, the helical groove 57 may be formed such that the upper end 57*a* of the helical groove 57 forming the secondary oil passage 70*a* formed on the outer circumferential surface of the lower end portion of the drive shaft 50 is exposed above the upper end of the secondary oil pump 70. When the upper end of the secondary oil passage 70*a* is exposed above the upper end of the secondary oil pump 70, the oil in the oil reservoir 16 may smoothly flow into the secondary oil passage 70*a*.

The lower end of the secondary oil passage 70*a* may be formed at the lower end of the drive shaft 50. Accordingly, oil flowing into the upper end of the secondary oil passage 70*a* may move to the lower end of the drive shaft 50 along the secondary oil passage 70*a*.

Referring to FIGS. 19 and 20, the secondary oil pump 70 is disposed at the lower end portion of the drive shaft 50. The secondary oil pump 70 may be disposed so that the upper end of the secondary oil pump 70 is adjacent to the lower surface of the rotor 22. At this time, the secondary oil pump 70 may be disposed as close to the lower surface of the rotor 22 as possible without contacting the lower surface of the rotor 22 so as not to interfere with the rotation of the rotor 22.

The secondary oil pump 70 is disposed to be submerged in the oil contained in the oil reservoir 16 at the lower portion of the case 10. The secondary oil pump 70 is disposed so that the oil inlet 72 is located below the surface OS of the oil contained in the oil reservoir 16, that is, the oil surface. At this time, the upper end of the secondary oil pump 70 may be located at the same height as the oil surface OS or below the oil surface OS. Accordingly, the secondary oil passage 70*a* of the secondary oil pump 70 may be located below the oil surface OS.

The secondary oil pump 70 may be formed in the shape of a cylindrical shape with a bottom. That is, the secondary oil pump 70 may be formed in a hollow cylindrical shape with an open top and a closed bottom.

The inner diameter of the secondary oil pump 70 is larger than the outer diameter of the lower portion of the drive shaft 50. For example, the gap between the inner circumferential surface of the secondary oil pump 70 and the outer circumferential surface of the lower portion of the drive shaft 50 may be 0.1 mm to 0.15 mm.

A coupling hole 73 may be formed in the bottom 701 of the secondary oil pump 70. The coupling hole 73 may be formed at the center of the bottom 701 of the secondary oil pump 70.

The coupling hole 73 is formed to be coupled to the coupling protrusion 63 of the primary oil pump 60. The coupling hole 73 may be formed with a female screw. That is, a female screw corresponding to the male screw 65 of the coupling protrusion 63 of the primary oil pump 60 may be formed on the inner circumferential surface of the coupling hole 73. Accordingly, the coupling protrusion 63 of the primary oil pump 60 may be screwed to the coupling hole 73 of the secondary oil pump 70.

The secondary oil pump 70 may include at least one oil inlet 72. The at least one oil inlet 72 may be formed on the outer circumferential surface of the cylindrical container. The at least one oil inlet 72 may be formed to penetrate the outer circumferential surface 702 and the inner circumferential surface 703 of the cylindrical container. The at least one oil inlet 72 may be formed on the upper portion of the outer circumferential surface of the secondary oil pump 70. The at least one oil inlet 72 may be formed adjacent to the upper end of the secondary oil pump 70.

The at least one oil inlet 72 may be formed to communicate with the secondary oil passage 70*a*. Accordingly, when the drive shaft 50 rotates, the oil in the oil reservoir 16 may flow into the secondary oil passage 70*a* through the at least one oil inlet 72.

In this embodiment, the secondary oil pump 70 includes two oil inlets 72, but the number of oil inlet 72 is not limited thereto.

When the at least one oil inlet 72 of the secondary oil pump 70 is submerged in the oil contained in the oil reservoir 16, the oil in the oil reservoir 16 may flow into the secondary oil passage 70*a* of the secondary oil pump 70 through the at least one oil inlet 72.

When the upper end of the secondary oil pump 70 is submerged in the oil in the oil reservoir 16, the oil in the oil reservoir 16 may flow into the secondary oil passage 70*a* through the at least one oil inlet 72 and the upper end of the secondary oil passage 70*a* exposed above the upper end of the secondary oil pump 70. Accordingly, a sufficient amount of oil may flow into the secondary oil passage 70*a*.

Figure 25:
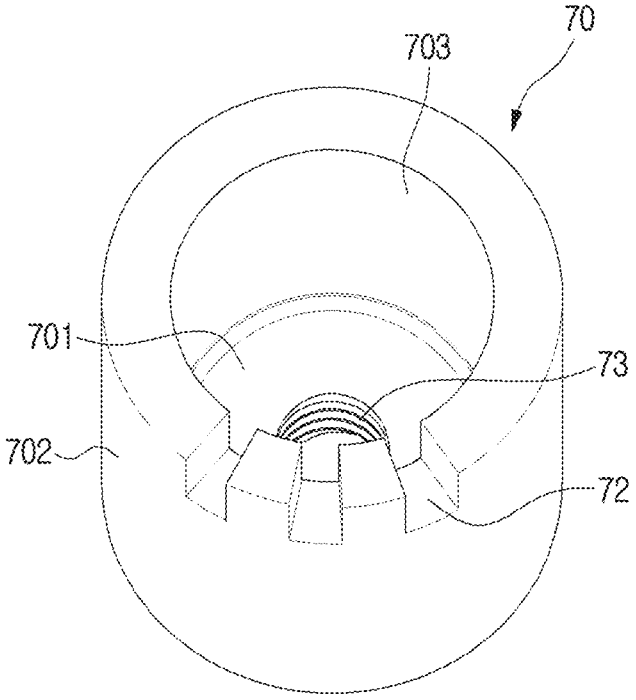
FIG. 25 is a perspective view illustrating a secondary oil pump of a reciprocating compressor according to an embodiment of the disclosure.

As another embodiment, as illustrated in FIG. 25, the plurality of oil inlets 72 may be formed at the upper end of the secondary oil pump 70.

FIG. 25 is a perspective view illustrating a secondary oil pump 70 of a reciprocating compressor 1 according to an embodiment of the disclosure.

Referring to FIG. 25, the secondary oil pump 70 may be formed in the shape of a cylindrical container with a bottom. That is, the secondary oil pump 70 may be formed in a hollow cylindrical shape with an open top and a closed bottom.

A coupling hole 73 may be formed in the bottom 701 of the secondary oil pump 70. The coupling hole 73 may be formed at the center of the bottom 701 of the secondary oil pump 70.

The coupling hole 73 is formed to be coupled to the coupling protrusion 63 of the primary oil pump 60. The coupling hole 73 may be formed with a female screw. That is, a female screw corresponding to the male screw 65 of the coupling protrusion 63 of the primary oil pump 60 may be formed on the inner circumferential surface of the coupling hole 73. Accordingly, the coupling protrusion 63 of the primary oil pump 60 may be screwed to the coupling hole 73 of the secondary oil pump 70.

At least one oil inlet 72 may be formed on the upper end of the secondary oil pump 70. That is, the at least one oil inlet 72 may be formed as a groove having a certain depth at the upper end of the secondary oil pump 70. The at least one oil inlet 72 may be formed to communicate with the secondary oil passage 70*a*.

In the embodiment shown in FIG. 25, three oil inlets 72 are formed at the upper end of the secondary oil pump 70.

The secondary oil pump 70 may be disposed so that the at least one oil inlet 72 is submerged in the oil contained in the oil reservoir 16. When the upper end of the secondary oil pump 70 is submerged in the oil in the oil reservoir 16, the oil in the oil reservoir 16 may flow into the secondary oil passage 70*a* of the secondary oil pump 70 through the at least one oil inlet 72.

Figure 26:
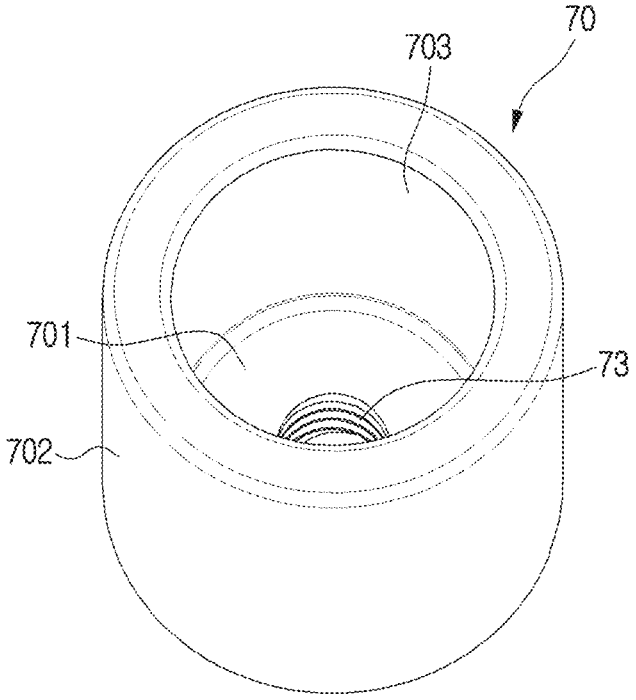
FIG. 26 is a perspective view illustrating a secondary oil pump of a reciprocating compressor according to an embodiment of the disclosure.

As another embodiment, as illustrated in FIG. 26, the secondary oil pump 70 may not include the oil inlet 72. In other words, the oil inlet 72 may not be formed on the outer circumferential surface of the secondary oil pump 70.

Figure 27:
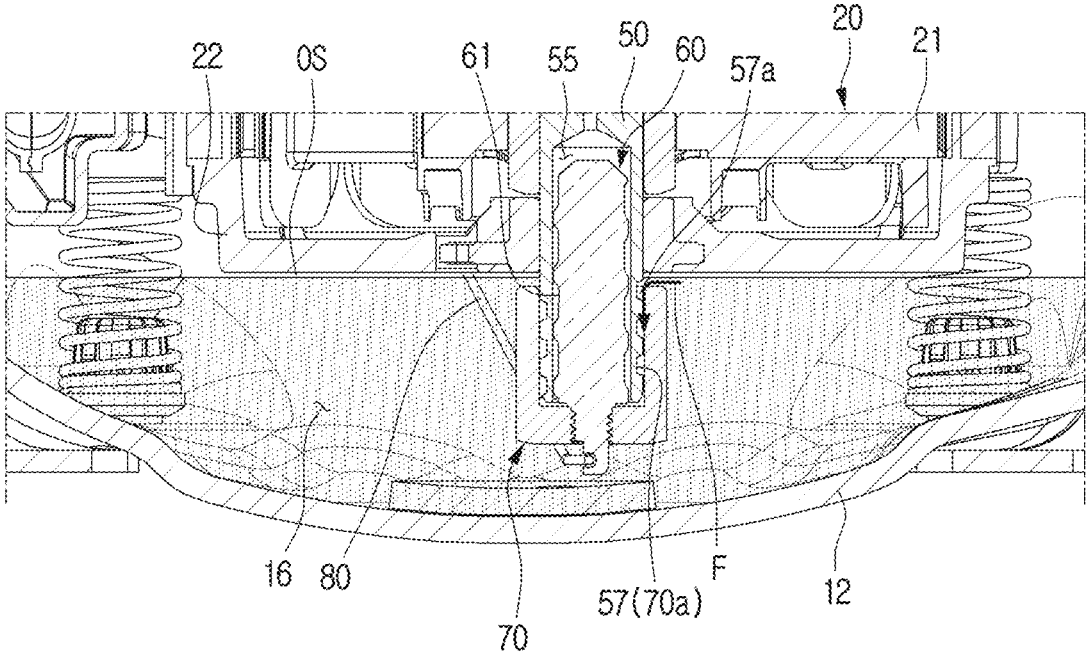
FIG. 27 is a partially enlarged cross-sectional view illustrating a state in which the secondary oil pump of FIG. 26 is immersed in an oil reservoir according to an embodiment of the disclosure.

FIG. 26 is a perspective view illustrating a secondary oil pump 70 of a reciprocating compressor 1 according to an embodiment of the disclosure. FIG. 27 is a partially enlarged cross-sectional view illustrating a state in which the secondary oil pump 70 of FIG. 26 is immersed in an oil reservoir 16 according to an embodiment of the disclosure.

Referring to FIG. 26, the secondary oil pump 70 may be formed in the shape of a cylindrical container with a bottom. That is, the secondary oil pump 70 may be formed in a hollow cylindrical shape with an open top and a closed bottom.

A coupling hole 73 may be formed in the bottom 701 of the secondary oil pump 70. The coupling hole 73 may be formed at the center of the bottom 701 of the secondary oil pump 70.

The coupling hole 73 is formed to be coupled to the coupling protrusion 63 of the primary oil pump 60. The coupling hole 73 may be formed with a female screw. That is, a female screw corresponding to the male screw 65 of the coupling protrusion 63 of the primary oil pump 60 may be formed on the inner circumferential surface of the coupling hole 73. Accordingly, the coupling protrusion 63 of the primary oil pump 60 may be screwed to the coupling hole 73 of the secondary oil pump 70.

The secondary oil pump 70 does not include an oil inlet 72. That is, the oil inlet 72 is not formed on the outer circumferential surface and bottom of the secondary oil pump 70.

Referring to FIG. 27, the secondary oil pump 70 may be disposed so as to be completely submerged in the oil contained in the oil reservoir 16. In other words, the secondary oil pump 70 may be disposed so that the upper end of the secondary oil pump 70 and the upper end 57*a* of the secondary oil passage 70*a* exposed above the upper end of the secondary oil pump 70 are submerged in the oil contained in the oil reservoir 16.

When the secondary oil pump 70 is completely submerged in the oil in the oil reservoir 16, the oil in the oil reservoir 16 may be flow into secondary oil passage 70*a* through the gap between the upper end of the secondary oil pump 70 and the outer circumferential surface of the lower portion of the drive shaft 50 and the upper end 57*a* of the secondary oil passage 70*a* exposed above the upper end of the secondary oil pump 70 (see arrow F).

Hereinafter, oil supply by the reciprocating compressor 1 according to an embodiment of the disclosure having the above structure will be described in detail with reference to FIGS. 19, 20, 21, 22, 23, 36, and 37.

Figure 36:
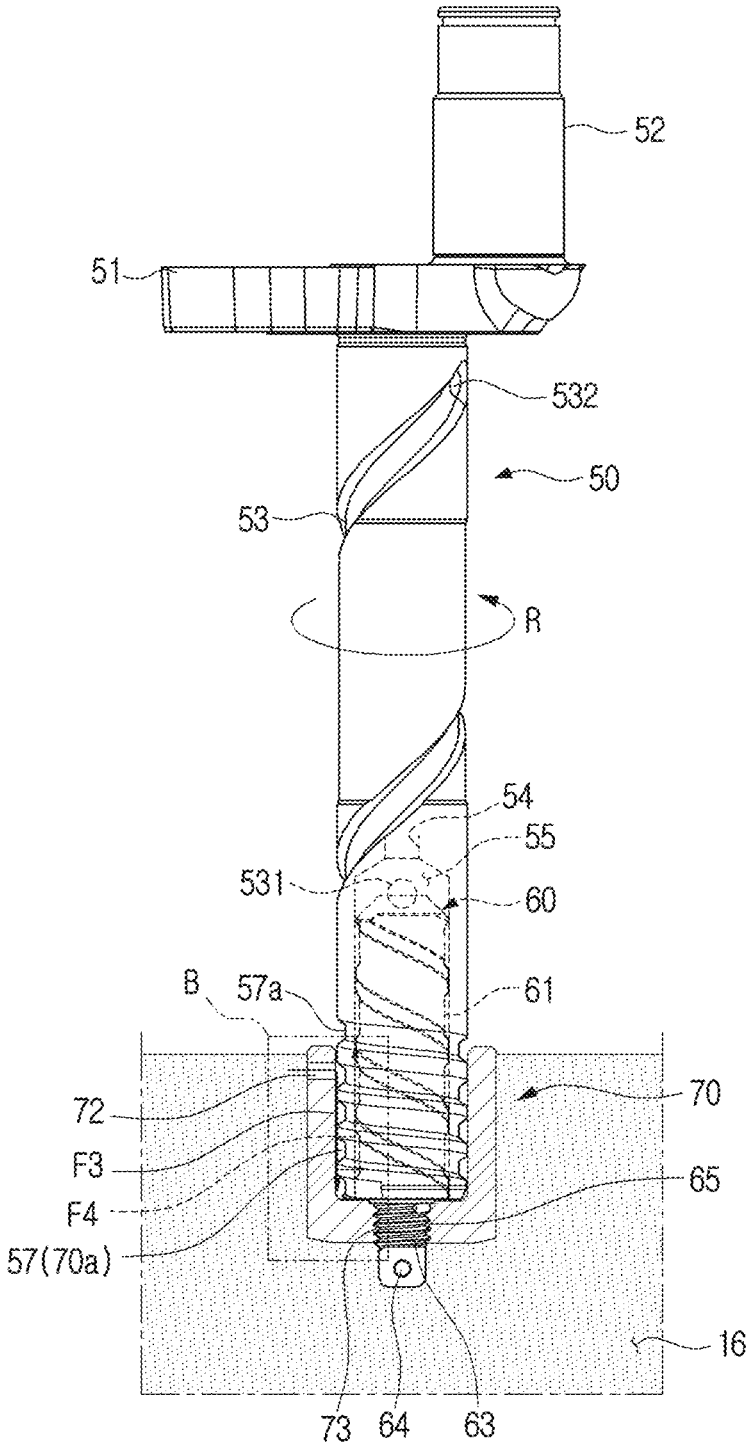
FIG. 36 is a view illustrating movement of oil by rotation of a drive shaft of a reciprocating compressor according to an embodiment of the disclosure.
Figure 37:
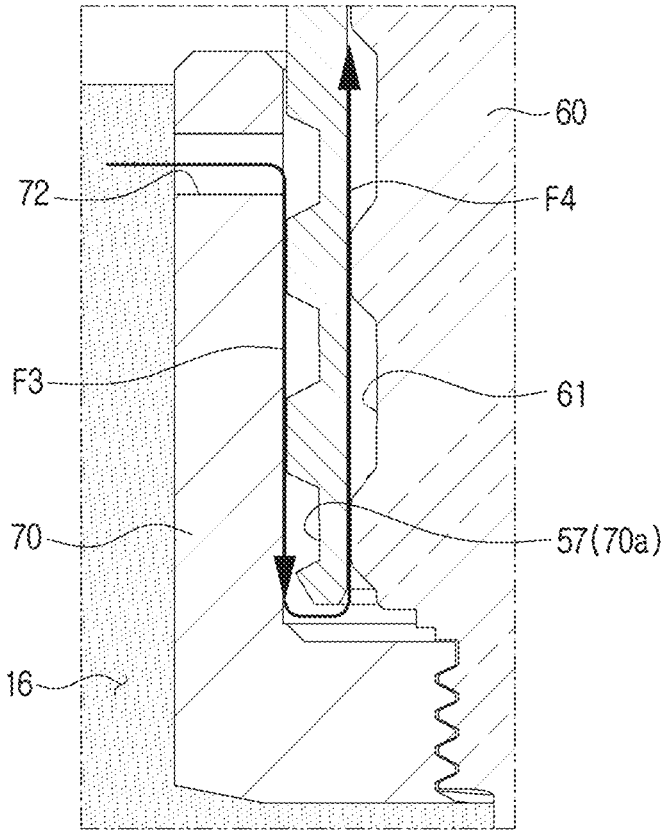
FIG. 37 is an enlarged cross-sectional view illustrating portion B of FIG. 36 according to an embodiment of the disclosure.

FIG. 36 is a view illustrating movement of oil by rotation of a drive shaft 50 of a reciprocating compressor 1 according to an embodiment of the disclosure. FIG. 37 is an enlarged cross-sectional view illustrating portion B of FIG. 36 according to an embodiment of the disclosure.

When the drive shaft 50 rotates integrally with the rotor 22, the oil contained in the oil reservoir 16 may be supplied to the upper side of the drive shaft 50 by the primary oil pump 60 and the secondary oil pump 70.

In detail, when the drive shaft 50 rotates in one direction R, the oil contained in the oil reservoir 16 may flow into the inside of the secondary oil pump 70 through the upper portion of the secondary oil pump 70. For example, the oil in the oil reservoir 16 may flow into the secondary oil pump 70 through at least one oil inlet 72 formed at the upper portion of the secondary oil pump 70.

The oil flowing into the secondary oil pump 70 moves downward, that is, to the bottom of the secondary oil pump 70 along the secondary oil passage 70*a* formed between the inner circumferential surface of the secondary oil pump 70 and the outer circumferential surface of the lower portion of the drive shaft 50 (see F3 in FIGS. 36 and 37). At this time, because the helical direction of the helical groove 57 forming the secondary oil passage 70*a* formed on the outer circumferential surface of the lower portion of the drive shaft 50 is formed in a direction opposite to the helical direction of the first oil supply passage 53 formed on the outer circumferential surface of the upper portion of the drive shaft 50, when the drive shaft 50 rotates, the oil moves toward the lower end of the drive shaft 50 along the secondary oil passage 70*a* formed on the lower portion of the drive shaft 50.

The oil that moves to the bottom of the secondary oil pump 70 along the secondary oil passage 70*a* moves to the primary oil passage 61 formed between the primary oil pump 60 and the inner circumferential surface of the cavity 55 of the drive shaft 50 through the gap between the lower end of the drive shaft 50 and the bottom of the secondary oil pump 70, and then is supplied to the upper portion of the cavity 55 along the primary oil pump 60 (see F4 in FIGS. 36 and 37). In other words, the oil in the oil reservoir 16 may move to the lower portion of the secondary oil pump 70 along the secondary oil passage 70*a*, and then may move to the upper portion of the cavity 55 along the primary oil passage 61.

Accordingly, when the drive shaft 50 rotates, the oil in the oil reservoir 16 may be supplied to the upper portion of the cavity 55 by the primary oil pump 60 and the secondary oil pump 70.

Some of the oil supplied to the upper portion of the cavity 55 moves to the first oil supply passage 53 through the first oil inlet 531. Some oil may be supplied between the outer circumferential surface of the drive shaft 50 and the inner circumferential surface of the fixed shaft 31 through the first oil supply passage 53. Some oil that has moved to the upper end of the first oil supply passage 53 may be supplied to the oil groove 521 of the crank shaft 52 through the first oil outlet 532 and the oil passage 522. The oil supplied to the oil groove 521 may be supplied to the crank shaft 52 and the connecting rod 45.

In addition, the remainder of the oil supplied to the upper portion of the cavity 55 may be supplied to the upper side of the drive shaft 50, that is, the upper surface of the head portion 51, through the second oil supply passage 54. The oil suppled to the upper surface of the head portion 51 may be supplied to the bearing 39 disposed in the head portion 51.

As described above, in the reciprocating compressor 1 according an embodiment of the disclosure, the oil in the oil reservoir 16 is supplied by two oil pumps, that is, the primary oil pump 60 disposed inside the cavity 55 of the drive shaft 50 and the secondary oil pump 70 disposed outside the cavity 55 of the drive shaft 50. Therefore, when the reciprocating compressor 1 operates at a low speed, sufficient oil may be supplied to the components of the reciprocating compressor 1.

In the above description, the secondary oil passage 70*a* is formed on the outer circumferential surface of the lower portion of the drive shaft 50. However, as another embodiment, the secondary oil passage 70*a* may be formed on the inner circumferential surface of the secondary oil pump 70.

Hereinafter, the drive shaft assembly having this structure will be described in detail with reference to FIGS. 28, 29, 30, and 31.

Figure 28:
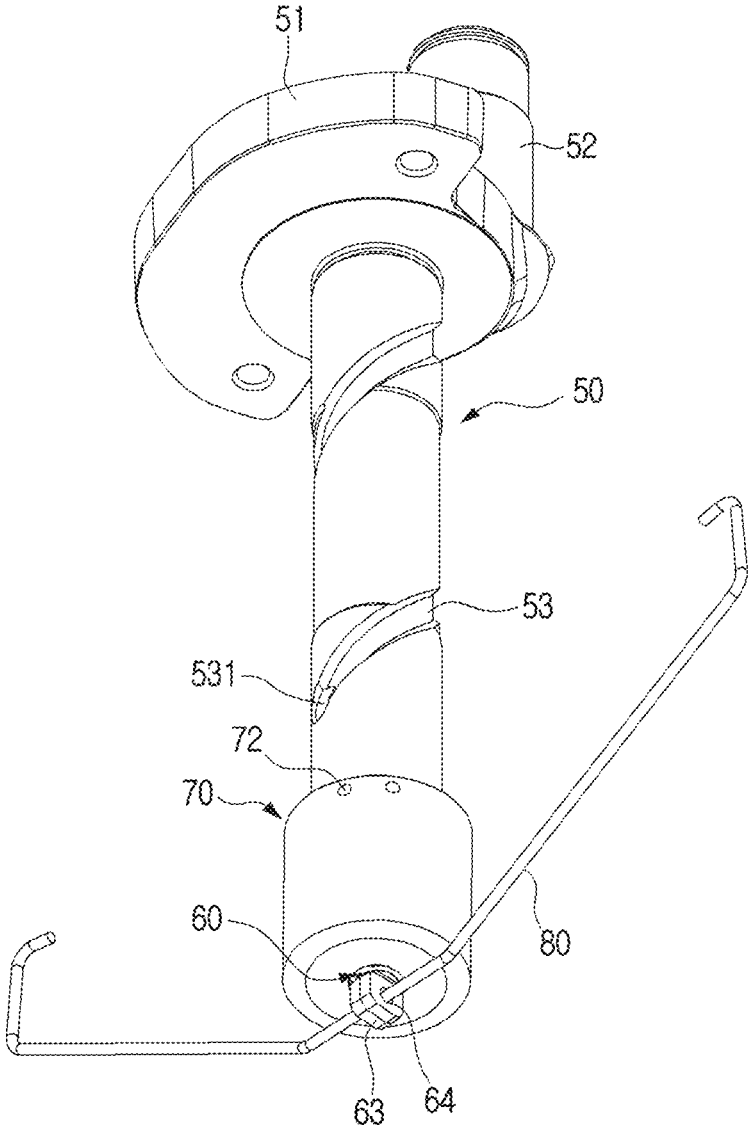
FIG. 28 is a perspective view illustrating a drive shaft assembly of a reciprocating compressor according to an embodiment of the disclosure.
Figure 29:
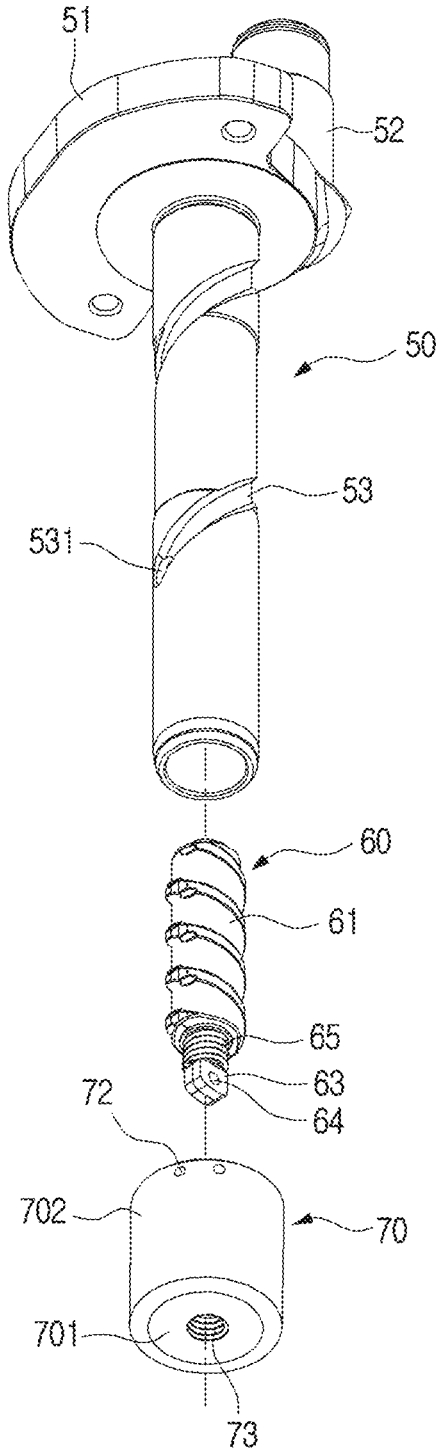
FIG. 29 is an exploded perspective view illustrating the drive shaft assembly of FIG. 28 according to an embodiment of the disclosure.
Figure 30:
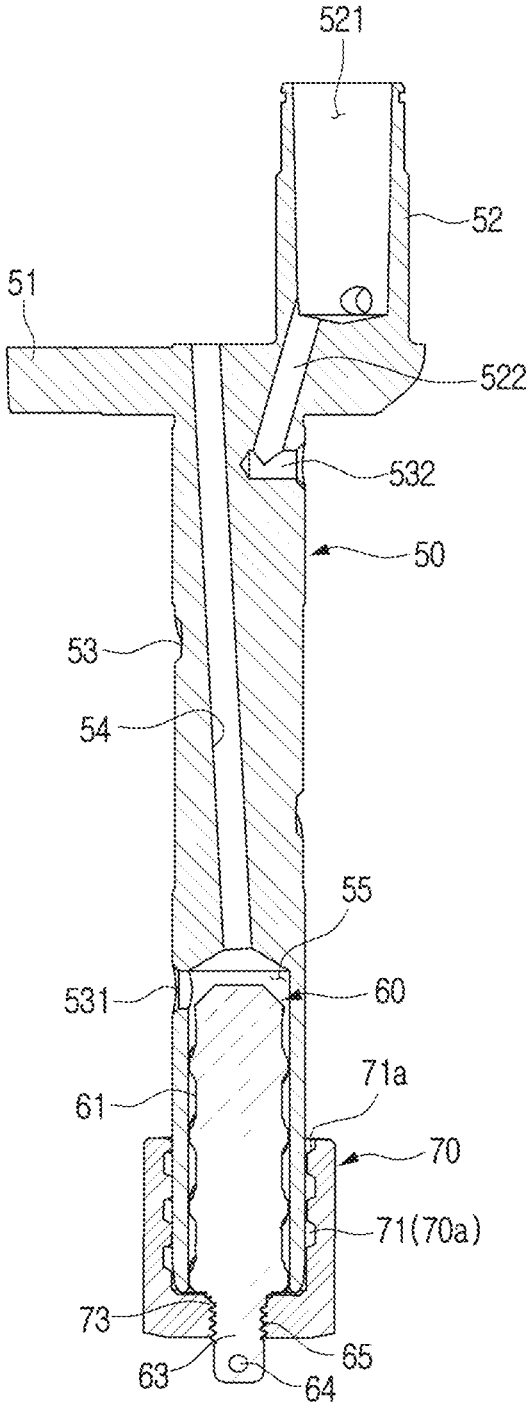
FIG. 30 is a cross-sectional view illustrating the drive shaft assembly of FIG. 28 according to an embodiment of the disclosure.
Figure 31:
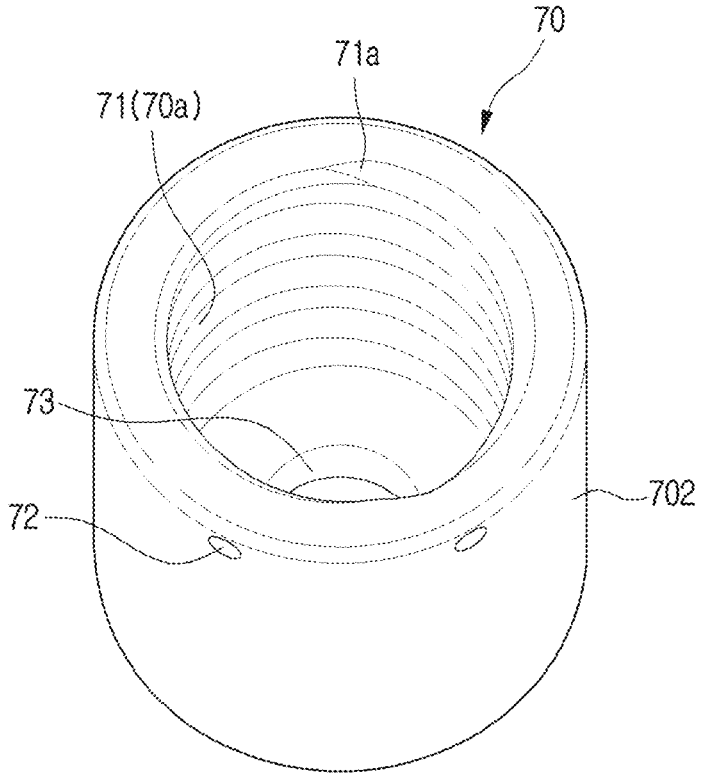
FIG. 31 is a perspective view illustrating a secondary oil pump of the drive shaft assembly of FIG. 28 according to an embodiment of the disclosure.

FIG. 28 is a perspective view illustrating a drive shaft assembly of a reciprocating compressor 1 according to an embodiment of the disclosure. FIG. 29 is an exploded perspective view illustrating the drive shaft assembly of FIG. 28 according to an embodiment of the disclosure. FIG. 30 is a cross-sectional view illustrating the drive shaft assembly of FIG. 28 according to an embodiment of the disclosure. FIG. 31 is a perspective view illustrating a secondary oil pump 70 of the drive shaft assembly of FIG. 28 according to an embodiment of the disclosure.

Referring to FIGS. 28, 29, 30, and 31, the drive shaft assembly may include a drive shaft 50, a primary oil pump 60, and a secondary oil pump 70.

The drive shaft 50 is formed to rotate integrally with the rotor 22 of the motor 20 to operate the compression part 40.

The primary oil pump 60 and the secondary oil pump 70 may be disposed at the lower portion of the drive shaft 50. The lower portion of the drive shaft 50 where the primary oil pump 60 and the secondary oil pump 70 are disposed is integrally with coupled with the rotor 22.

The drive shaft 50 may include a cavity 55, a first oil supply passage 53, and a second oil supply passage 54. The cavity 55, the first oil supply passage 53, and the second oil supply passage 54 of the drive shaft 50 are the same as those of the drive shaft 50 according to the above-described embodiment. Therefore, detailed descriptions thereof are omitted.

The primary oil pump 60 may be disposed at the lower portion of the drive shaft 50. In detail, the primary oil pump 60 is disposed to be inserted into the cavity 55 of the drive shaft 50. The portion of the drive shaft 50 protruding below the rotor 22 and the lower portion of the primary oil pump 60 are disposed to be submerged in the oil contained in the oil reservoir 16.

The primary oil pump 60 is the same as the above-described embodiment. Therefore, a detailed description thereof is omitted.

The secondary oil pump 70 is disposed at the lower portion of the drive shaft 50. The secondary oil pump 70 may be disposed outside the primary oil pump 60. That is, the secondary oil pump 70 may be disposed to surround the primary oil pump 60. The secondary oil pump 70 may be disposed to surround the primary oil pump 60 and the lower portion of the drive shaft 50.

The secondary oil pump 70 may be disposed concentrically with the primary oil pump 60. A secondary oil passage 70*a* is formed between the outer circumferential surface of the lower portion of the drive shaft 50 and the secondary oil pump 70.

The secondary oil passage 70*a* may be formed as a helical groove 71. The diameter of the helical groove 71 forming the secondary oil passage 70*a* is larger than the diameter of the helical groove 71 of the primary oil pump 60. That is, the secondary oil passage 70*a* may be formed around the primary oil passage 61.

The secondary oil passage 70*a* may be formed as the helical groove 71 formed on the inner circumferential surface 703 of the secondary oil pump 70. The helical direction of the helical groove 71, which is the secondary oil passage 70*a* formed on the inner circumferential surface 703 of the secondary oil pump 70, may be formed in the same direction as the helical direction of the first oil supply passage 53 formed on the outer circumferential surface of the upper portion of the drive shaft 50. For example, when the helical direction of the first oil supply passage 53 is a right-handed helical direction, the helical direction of the secondary oil passage 70*a* is a right-handed helical direction.

Therefore, when the drive shaft 50 rotates, the oil in the oil reservoir 16 moves downward along the helical groove 71 formed on the inner circumferential surface of the secondary oil pump 70, that is, the secondary oil passage 70*a* by the viscous friction force with the outer circumferential surface of the rotating drive shaft 50.

The lower end portion of the drive shaft 50 is inserted into the secondary oil pump 70, and the secondary oil pump 70 is formed to be coupled to the primary oil pump 60. Because the primary oil pump 60 is fixed to the case 10, when the secondary oil pump 70 is coupled to the primary oil pump 60, the secondary oil pump 70 is fixed to the case 10. Therefore, when the drive shaft 50 rotates, the secondary oil pump 70 does not rotate.

The upper end of the secondary oil passage 70*a* may be formed at the upper end of the secondary oil pump 70. That is, a groove 71*a* communicating with the secondary oil passage 70*a* may be formed at the upper end of the secondary oil pump 70. When the upper end of the secondary oil passage 70*a* is formed at the upper end of the secondary oil pump 70, the oil in the oil reservoir 16 may smoothly flow into the secondary oil passage 70*a*.

The lower end of the secondary oil passage 70*a* may be formed adjacent to or in contact with the bottom of the secondary oil pump 70. Therefore, oil flowing into the upper end of the secondary oil passage 70*a* may move to the bottom of the secondary oil pump 70 along the secondary oil passage 70*a*.

The secondary oil pump 70 is disposed at the lower end portion of the drive shaft 50. The secondary oil pump 70 may be disposed so that the upper end of the secondary oil pump 70 is adjacent to the lower surface of the rotor 22. At this time, the secondary oil pump 70 may be disposed as close to the lower surface of the rotor 22 as possible without contacting the lower surface of the rotor 22 so as not to interfere with the rotation of the rotor 22.

The secondary oil pump 70 is disposed to be submerged in the oil contained in the oil reservoir 16 at the lower portion of the case 10. The secondary oil pump 70 is disposed so that the oil inlet 72 is located below the surface OS of the oil contained in the oil reservoir 16, that is, the oil surface. At this time, the upper end of the secondary oil pump 70 may be located at the same height as the oil surface OS or below the oil surface OS. Accordingly, the secondary oil passage 70*a* of the secondary oil pump 70 may be located below the oil surface OS.

The secondary oil pump 70 may be formed in the shape of a cylindrical shape with a bottom. That is, the secondary oil pump 70 may be formed in a hollow cylindrical shape with an open top and a closed bottom.

The inner diameter of the secondary oil pump 70 is larger than the outer diameter of the lower portion of the drive shaft 50. For example, the gap between the inner circumferential surface of the secondary oil pump 70 and the outer circumferential surface of the lower portion of the drive shaft 50 may be 0.1 mm to 0.15 mm.

A helical groove 71 may be formed on the inner circumferential surface of the secondary oil pump 70. This helical groove 71 forms the secondary oil passage 70*a*.

A coupling hole 73 may be formed in the bottom 701 of the secondary oil pump 70. The coupling hole 73 may be formed at the center of the bottom 701 of the secondary oil pump 70.

The coupling hole 73 is formed to be coupled to the coupling protrusion 63 of the primary oil pump 60. The coupling hole 73 may be formed with a female screw. That is, a female screw corresponding to the male screw 65 of the coupling protrusion 63 of the primary oil pump 60 may be formed on the inner circumferential surface of the coupling hole 73. Accordingly, the coupling protrusion 63 of the primary oil pump 60 may be screwed to the coupling hole 73 of the secondary oil pump 70.

The secondary oil pump 70 may include at least one oil inlet 72. The at least one oil inlet 72 may be formed on the outer circumferential surface of the cylindrical container. The at least one oil inlet 72 may be formed to penetrate the outer circumferential surface 702 and the inner circumferential surface of the cylindrical container. The at least one oil inlet 72 may be formed on the upper portion of the outer circumferential surface 702 of the secondary oil pump 70. The at least one oil inlet 72 may be formed adjacent to the upper end of the secondary oil pump 70.

The at least one oil inlet 72 may be formed to communicate with the secondary oil passage 70*a*. Accordingly, the oil in the oil reservoir 16 may flow into the secondary oil passage 70*a* through the at least one oil inlet 72.

In this embodiment, the secondary oil pump 70 includes two oil inlets 72, but the number of oil inlets 72 is not limited thereto.

When the at least one oil inlet 72 of the secondary oil pump 70 is submerged in the oil contained in the oil reservoir 16, the oil in the oil reservoir 16 may flow into the secondary oil passage 70*a* of the secondary oil pump 70 through the at least one oil inlet 72.

When the upper end of the secondary oil pump 70 is submerged in the oil in the oil reservoir 16, the oil in the oil reservoir 16 may flow into the secondary oil passage 70*a* through the at least one oil inlet 72 and the upper end of the secondary oil passage 70*a* formed on the upper end of the secondary oil pump 70. Accordingly, a sufficient amount of oil may flow into the secondary oil passage 70*a*.

As another embodiment, the secondary oil pump 70 may not include the oil inlet 72. In this case, the secondary oil pump 70 may be disposed so that the upper end of the secondary oil pump 70 is located below the oil surface of the oil reservoir 16 (see FIG. 27).

In the above, the case where the primary oil pump 60 and the secondary oil pump 70 are coupled by screw coupling has been described. However, the coupling of the primary oil pump 60 and the secondary oil pump 70 is not limited to this. As long as oil does not penetrate into the joint portion between the primary oil pump 60 and the secondary oil pump 70, various coupling methods may be applied. For example, the primary oil pump 60 and the secondary oil pump 70 may be coupled by press-fitting.

Hereinafter, the press-fit coupling of the primary oil pump 60 and the secondary oil pump 70 will be described with reference to FIGS. 32 and 33.

Figure 32:
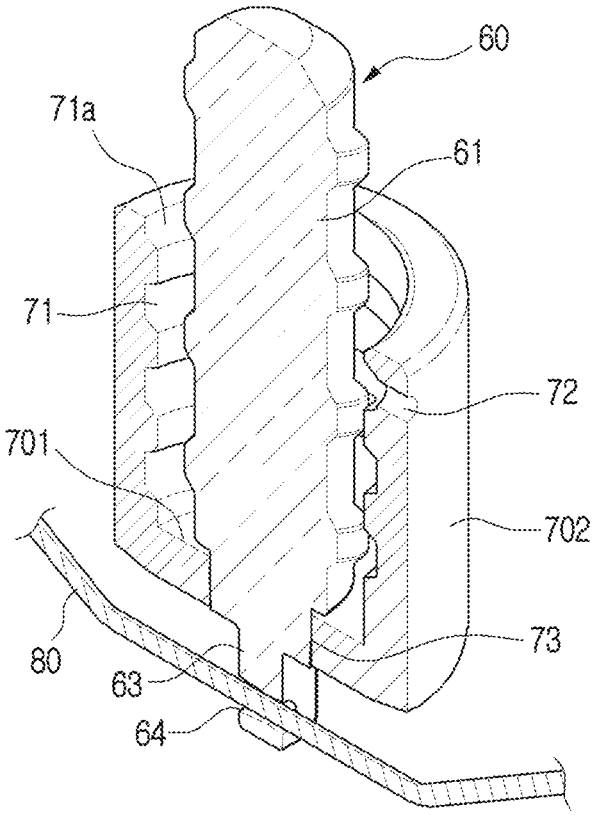
FIG. 32 is a perspective view illustrating a state in which a primary oil pump and a secondary oil pump of a reciprocating compressor are coupled to each other according to an embodiment of the disclosure.

FIG. 32 is a perspective view illustrating a state in which a primary oil pump 60 and a secondary oil pump 70 of a reciprocating compressor 1 are coupled to each other according to an embodiment of the disclosure.

Referring to FIG. 32, the primary oil pump 60 and the secondary oil pump 70 are coupled by press-fitting. The coupling protrusion 63 of the primary oil pump 60 is formed in a cylindrical shape, and the coupling hole 73 of the secondary oil pump 70 is formed as a circular hole. In this case, the diameter of the coupling protrusion 63 and the inner diameter of the coupling hole 73 are formed to provide an interference fit. Then, the coupling protrusion 63 of the primary oil pump 60 is pressed into the coupling hole 73 of the secondary oil pump 70, thereby coupling the primary oil pump 60 and the secondary oil pump 70.

In this case, the coupling protrusion 63 of the primary oil pump 60 is press-fitted and fixed to the coupling hole 73 of the secondary oil pump 70, so that the secondary oil pump 70 does not rotate with respect to the primary oil pump 60 and oil does not flow into the inside of the secondary oil pump 70 through between the coupling hole 73 and the coupling protrusion 63.

In addition, a through hole 64 is formed in the lower portion of the coupling protrusion 63 of the primary oil pump 60. A metal wire 80 fixed to the lower case 12 is inserted into the through hole 64. Therefore, when the drive shaft 50 rotates, the primary oil pump 60 and the secondary oil pump 70 do not rotate.

Figure 33:
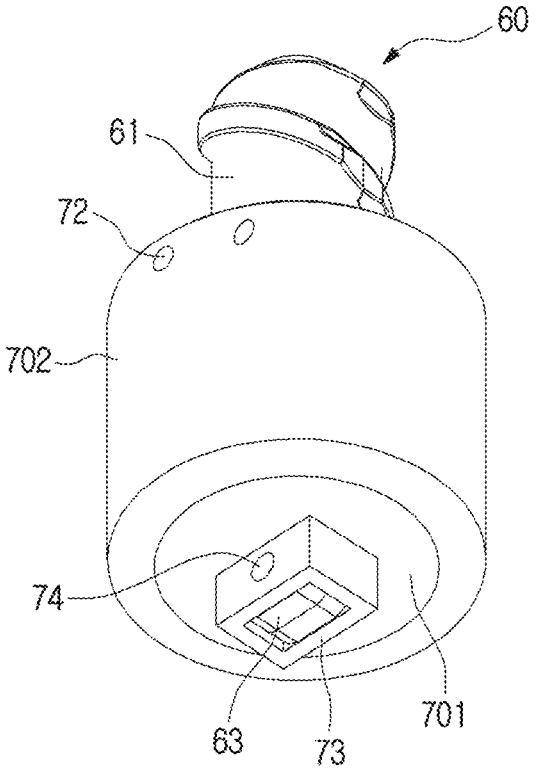
FIG. 33 is a perspective view illustrating a state in which a primary oil pump and a secondary oil pump of a reciprocating compressor are coupled to each other according to an embodiment of the disclosure.

FIG. 33 is a perspective view illustrating a state in which a primary oil pump 60 and a secondary oil pump 70 of a reciprocating compressor 1 are coupled to each other according to an embodiment of the disclosure.

Referring to FIG. 33, the primary oil pump 60 and the secondary oil pump 70 are coupled by press fitting. The coupling protrusion 63 of the primary oil pump 60 is formed in the shape of a square pillar, and the coupling hole 73 of the secondary oil pump 70 is formed as a square hole. The coupling hole 73 may be formed in the shape of a square pipe extending downward from the bottom 701 of the secondary oil pump 70.

In this case, the square pillar-shaped coupling protrusion 63 is formed to be press-fitted into the square coupling hole 73. That is, the coupling protrusion 63 and the coupling hole 73 are formed so that the coupling protrusion 63 is press-fitted into the coupling hole 73 to prevent oil from penetrating between the coupling protrusion 63 and the coupling hole 73. Then, the coupling protrusion 63 of the primary oil pump 60 is press-fitted into the coupling hole 73 of the secondary oil pump 70, thereby coupling the primary oil pump 60 and the secondary oil pump 70.

At this time, because the coupling protrusion 63 having the square pillar shape of the primary oil pump 60 is press-fitted into the coupling hole 73 having the square hole shape of the secondary oil pump 70, the secondary oil pump 70 does not rotate with respect to the primary oil pump 60, and oil does not flow into the inside of the secondary oil pump 70 through between the coupling hole 73 and the coupling protrusion 63.

In addition, a through hole 64 is formed in the lower portion of the coupling protrusion 63 of the primary oil pump 60. A hole 74 corresponding to the through hole 64 is formed on the side surface of the square pipe forming the coupling hole 73 of the secondary oil pump 70. A metal wire 80 fixed to the lower case 12 is inserted into the hole 74 of the secondary oil pump 70 and the through hole 64 of the primary oil pump 60. Therefore, when the drive shaft 50 rotates, the primary oil pump 60 and the secondary oil pump 70 do not rotate.

When the oil in the oil reservoir 16 flows into the inside of the secondary oil pump 70 through the upper portion of the secondary oil pump 70 as in the embodiment shown in FIGS. 19 to 33, compared to the case where the oil in the oil reservoir 16 flows into the inside of the secondary oil pump 70 through the lower portion of the secondary oil pump 70 as in the embodiment illustrated shown in FIGS. 2 to 18, there is no flow interference between the oil flowing along the secondary oil passage 70*a* and the oil flowing along the primary oil passage 61 and the oil flowing into the secondary oil pump 70 does not leak out through the upper end of the secondary oil pump 70. Therefore, the amount of oil supply may increase.

In general, a refrigerator needs to rapidly cool the internal space to a target temperature and maintain the internal temperature constant when the temperature of the internal space reaches the target temperature. At this time, it is preferable to keep the temperature fluctuation range small. In order to reduce the range of the temperature fluctuations, it is necessary to allow the reciprocating compressor 1 to operate at a low speed. In addition, when the reciprocating compressor 1 operates at a low speed, power consumption decreases.

The reciprocating compressor 1 is configured to operate an oil pump by rotating the drive shaft 50 to supply oil to internal components that require oil supply. The amount of oil supplied varies depending on the rotation speed of the drive shaft 50.

Because the reciprocating compressor according to the prior art has only one oil pump, when the reciprocating compressor operates at a low speed, the amount of oil supplied to the internal components of the reciprocating compressor is reduced. When the amount of oil supplied to the internal components is reduced, friction loss in the internal components may increase, thereby reducing the compressor efficiency. In addition, solid contact friction occurs between the components, which may increase vibration and noise in the reciprocating compressor. Therefore, the reliability of the reciprocating compressor may decrease.

However, the reciprocating compressor 1 according to an embodiment of the disclosure supplies oil using a dual oil pump, that is, the primary oil pump 60 and the secondary oil pump 70, so that the oil supply amount may be increased compared to the reciprocating compressor according to the prior art using a single oil pump.

In detail, because the reciprocating compressor 1 according to an embodiment of the disclosure uses a dual oil pump, that is, the primary oil pump 60 and the secondary oil pump 70, the length of the helical oil passage of the oil pump for raising the oil is longer than the length of the helical oil passage of the oil pump of the reciprocating compressor according to the prior art using a single oil pump, that is, only the primary oil pump. Therefore, the amount of oil supply may be increased.

For example, in the case of the reciprocating compressor 1 according to embodiment of the disclosure illustrated in FIGS. 34 and 35, oil is flowing through the primary oil passage 61 and the secondary oil passage 70*a* of the dual oil pump (F1 and F2), the length of the oil passage is longer than that of the reciprocating compressor according to the prior art in which oil moves only along the primary oil passage (e.g., F1). Therefore, the amount of oil supply may be increased.

In addition, in the case of the reciprocating compressor 1 according to an embodiment of the disclosure illustrated in FIGS. 36 and 37, oil sequentially flows through the primary oil passage 61 and the secondary oil passage 70*a* of the dual oil pump (F3 and F4), the length of the oil passage is longer than that of the reciprocating compressor according to the prior art in which oil moves only along the primary oil passage (e.g., F4). Therefore, the amount of oil supply may be increased.

Accordingly, the reciprocating compressor 1 according to an embodiment of the disclosure may improve compressor efficiency and reduce vibration and noise. Therefore, the reliability of the reciprocating compressor 1 according to an embodiment of the disclosure may be improved.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A reciprocating compressor comprising:

a case containing an oil reservoir;

a motor including a stator disposed inside the case and a rotor that rotates with respect to the stator;

a drive shaft that rotates integrally with the rotor and includes a cavity formed at a lower portion thereof;

a primary oil pump inserted into the cavity of the drive shaft and disposed in the case, the primary oil pump including a coupling protrusion protruding from a lower end thereof;

a secondary oil pump into which a lower end portion of the drive shaft is inserted and coupled to the primary oil pump, the secondary oil pump including a coupling hole, formed on a bottom thereof, into which the coupling protrusion of the primary oil pump is inserted;

a primary oil passage formed between an inner circumferential surface of the cavity of the drive shaft and the primary oil pump; and a secondary oil passage formed around the primary oil pump between an outer circumferential surface of the lower end portion of the drive shaft and the secondary oil pump, wherein, when the drive shaft rotates, oil contained in the oil reservoir moves to an upper portion of the cavity of the drive shaft along the primary oil passage and the secondary oil passage.

2. The reciprocating compressor of claim 1, wherein the drive shaft includes a helical shaped first oil supply passage formed on an outer circumferential surface of an upper portion of the drive shaft, and wherein the secondary oil pump is formed in a shape of a cylindrical container with a bottom.

3. The reciprocating compressor of claim 2, wherein the drive shaft includes a communication hole formed adjacent to an upper end of the cavity, wherein the oil contained in the oil reservoir flows into the secondary oil pump through a lower portion of the secondary oil pump, and wherein some of the oil that flows into the secondary oil pump moves upward along the primary oil passage, and the remaining oil moves upward along the secondary oil passage, flows into the cavity through the communication hole, and moves to the upper portion of the cavity along with the some of the oil moving along the primary oil pump.

4. The reciprocating compressor of claim 3, wherein the secondary oil passage is formed as a helical groove formed on the outer circumferential surface of the lower portion of the drive shaft inserted into the secondary oil pump, and wherein a helical direction of the helical groove of the secondary oil passage is identical to a helical direction of the helical shaped first oil supply passage.

5. The reciprocating compressor of claim 3, wherein the secondary oil passage is formed as a helical groove formed on the inner circumferential surface of the secondary oil pump, and wherein a helical direction of the helical groove of the secondary oil passage is opposite to a helical direction of the helical shaped first oil supply passage.

6. The reciprocating compressor of claim 3, wherein the secondary oil pump includes a plurality of oil inlets formed in at least one of a bottom or a lower portion of the outer circumferential surface adjacent to the bottom.

7. The reciprocating compressor of claim 3, wherein an upper end of the secondary oil passage is formed below an upper end of the secondary oil pump.

8. The reciprocating compressor of claim 7, wherein the upper end of the secondary oil passage is formed to correspond to the communication hole.

9. The reciprocating compressor of claim 3, wherein an upper end of the secondary oil pump is adjacent to a lower surface of the rotor and is located above a surface of the oil contained in the oil reservoir.

10. The reciprocating compressor of claim 2, wherein the oil contained in the oil reservoir flows into the secondary oil pump through an upper portion of the secondary oil pump, and wherein the oil flowing into the secondary oil pump moves to a lower end of the drive shaft along the secondary oil passage, and then moves to the upper portion of the cavity of the drive shaft along the primary oil passage.

11. The reciprocating compressor of claim 10, wherein the secondary oil passage is formed as a helical groove formed on the outer circumferential surface of the lower portion of the drive shaft inserted into the secondary oil pump, and wherein a helical direction of the helical groove of the secondary oil passage is opposite to a helical direction of the helical shaped first oil supply passage.

12. The reciprocating compressor of claim 10, wherein the secondary oil passage is formed as a helical groove formed on the inner circumferential surface of the secondary oil pump, and wherein a helical direction of the helical groove of the secondary oil passage is identical to a helical direction of the helical shaped first oil supply passage.

13. The reciprocating compressor of claim 10, wherein the secondary oil pump includes at least one oil inlet formed on the outer circumferential surface adjacent to an upper end of the secondary oil pump.

14. The reciprocating compressor of claim 10, wherein an upper end of the secondary oil passage is formed at the upper end of the secondary oil pump.

15. The reciprocating compressor of claim 10, wherein an upper end of the secondary oil pump is adjacent to a lower surface of the rotor and is located below a surface of the oil contained in the oil reservoir.

16. The reciprocating compressor of claim 2, wherein a gap between an inner circumferential surface of the secondary oil pump and an outer circumferential surface of a lower portion of the drive shaft is 0.1 millimeters (mm) to 0.15 mm.

17. The reciprocating compressor of claim 1, wherein the coupling hole is formed in one of a circular, polygonal, or oval shape.

18. The reciprocating compressor of claim 1, wherein the primary oil pump and the secondary oil pump are coupled by screw coupling or press-fit coupling.

* * * * *